United States Patent [19]

Akred et al.

[11] Patent Number: 4,659,497

[45] **Date of Patent: * Apr. 21, 1987**

[54] LIQUID DETERGENT COMPOSITIONS

[75] Inventors: Brian J. Akred, Whitehaven; Edward T. Messenger, Workington; William J. Nicholson, Whitehaven, all of England

[73] Assignee: Albright & Wilson Limited, Warley, England

[ * ] Notice: The portion of the term of this patent subsequent to May 7, 2002 has been disclaimed.

[21] Appl. No.: 730,349

[22] Filed: May 3, 1985

Related U.S. Application Data

[62] Division of Ser. No. 464,019, Feb. 4, 1983, Pat. No. 4,515,704.

[30] Foreign Application Priority Data

| | | | |
|---|---|---|---|
| Feb. 5, 1982 | [GB] | United Kingdom | 8203398 |
| Apr. 13, 1982 | [GB] | United Kingdom | 8210670 |
| Jul. 2, 1982 | [GB] | United Kingdom | 8219227 |
| Dec. 23, 1982 | [GB] | United Kingdom | 8236664 |

[51] Int. Cl.[4] ..... C11D 1/12; C11D 7/14; C11D 7/16

[52] U.S. Cl. ..... 252/135; 252/155; 252/173; 252/174.25; 252/539; 252/540; 252/DIG. 14

[58] Field of Search ..... 252/174.25, 135, 539, 252/540, DIG. 14, 173, 155

[56] References Cited

U.S. PATENT DOCUMENTS

| | | | |
|---|---|---|---|
| 3,346,504 | 10/1967 | Herrmann | 252/529 |
| 3,346,873 | 10/1967 | Herrmann | 252/529 |
| 4,018,720 | 4/1977 | Lengyel et al. | 252/531 |
| 4,107,067 | 8/1978 | Murphy et al. | 252/174.21 X |
| 4,279,786 | 7/1981 | Sekiguchi et al. | 252/121 X |
| 4,299,740 | 11/1981 | Messenger et al. | 252/173 X |
| 4,302,347 | 11/1981 | Straw et al. | 252/531 X |
| 4,515,704 | 5/1985 | Akred et al. | 252/135 |

FOREIGN PATENT DOCUMENTS

| | | | |
|---|---|---|---|
| 855893 | 7/1960 | United Kingdom | 91/D2 |
| 2028365 | 3/1980 | United Kingdom . | |
| 2031455 | 4/1980 | United Kingdom . | |

*Primary Examiner*—John E. Kittle
*Assistant Examiner*—Mukund J. Shah
*Attorney, Agent, or Firm*—Hopgood, Califmade, Kalil, Blaustein & Judlowe

[57] ABSTRACT

Pourable, fluid, non sedimenting, laundry detergent composition, comprising water, surfactant, builder, a surfactant desolubilizing electrolyte and, optionally, the usual minor ingredients, consist essentially of: at least one predominantly aqueous liquid phase which is separable into a distinct layer by centrifuging the composition at 800 times normal earth gravity at 25° C. for 17 hours, and which contains at least part of the electrolyte and less than 75% by weight, preferably less than 10% by weight, of the surfactant, and one or more other phases which together contain at least part of the builder as solid particles dispersed in the composition and at least part of the surfactant, preferably either as a network of solid surfactant hydrate, or as a "G" phase liquid crystal which may be associated with an "L" phase, micellar solution.

27 Claims, 18 Drawing Figures

LIQUID DETERGENT COMPOSITIONS

Figure 1:
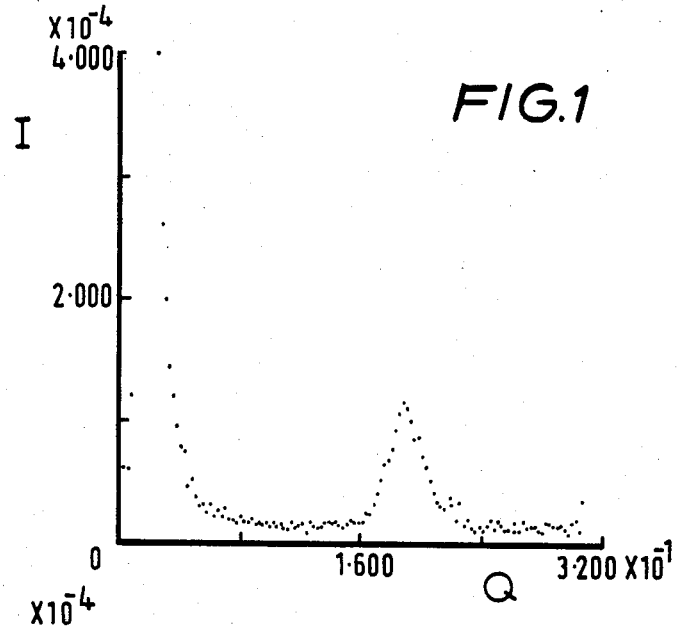

This is a division of application Ser. No. 464,019 filed Feb. 4, 1983, now U.S. Pat. No. 4,515,704.

DEFINITIONS

The present invention relates to novel, aqueous-based, pourable, fluid detergent compositions containing effective quantities of detergent builder.

The term "builder" is sometimes used loosely in the detergent art to include any non-surfactant whose presence in a detergent formulation enhances the cleaning effect of the formulation. More usually, however, the term is restricted to those typical "builders", which are primarily useful as a means of preventing or ameliorating the adverse effects on washing of calcium and magnesium ions e.g. by chelation, sequestering, precipitation or absorption of the ions, and secondarily as a source of alkalinity and buffering. The term "Builder" is used herein in the latter sense, and refers to additives which produce the foregoing effects to a substantial extent. It includes sodium or potassium tripolyphosphate and other phosphate and condensed phosphate salts such as sodium or potassium orthophosphates, pyrophosphates, metaphosphates or tetraphosphate, as well as phosphonates such as acetodiphosphonates, amino tris methylene phosphonates and ethylenediamine tetramethylene phosphonates. It also includes alkali metal carbonates, zeolites and such organic sequestrants as salts of nitrilotriacetic acid, citric acid and ethylene diamine tetracetic acid, polymeric polycarboxylic acids such as polyacrylates and maleic anhydride based copolymers.

For the avoidance of doubt, "Builder" is used herein to include water soluble alkali metal silicates such as sodium silicate, but excludes additives such as carboxymethyl cellulose, or polyvinyl pyrrolidone whose function is primarily that of soil suspending or anti-redeposition agent.

"Electrolyte" is used herein to denote those water soluble ionic compounds which dissociate at least partially in aqueous solution to provide ions, and which tend to lower the solubility or micellar concentration of surfactants in such solutions by a "salting out" effect. It includes water soluble dissociable, inorganic salts such as, for example alkali metal or ammonium sulphates, chlorides, nitrates, phosphates, carbonates, silicates, perborates and polyphosphates, and also certain water soluble organic salts which desolubilise or "salt out" surfactants. It does not include salts of cations which form water insoluble precipitates with the surfactants present.

"Hydrotope" denotes any water soluble compound which tends to increase the solubility of surfactants in aqueous solution. Typical hydrotopes include urea and the alkali metal or ammonium salts of the lower alkyl benzene sulphonic acids such as sodium toluene sulphonate and sodium xylene sulphonate.

As used herein "Soap" means an at least sparingly water soluble salt of a natural or synthetic aliphatic monocarboxylic acid, which salt has surfactant properties. The term includes sodium, potassium, lithium, ammonium and alkanolamine salts of $C_{8-22}$ natural and synthetic fatty acids, including stearic, palmitic, oleic, linoleic, ricinoleic, behenic and dodecanoic acids, resin acids and branched chain monocarboxylic acids.

The "Usual Minor Ingredients" includes those ingredients other than Water, Active Ingredients, Builders and Electrolytes which may be included in laundry detergent compositions, typically in proportions up to 5%, and which are compatible in the relevant Formulation with a pourable, chemically stable Non-sedimenting composition. The term includes antiredeposition agents, perfumes, dyes, optical brightening agents, hydrotropes, solvents, buffers, bleaches, corrosion inhibitors, antioxidants, preservatives, scale inhibitors, humectants, enzymes and their stabilizers, bleach activators, and the like.

As used herein "Functional Ingredients" means ingredients which are required to provide a beneficial effect in the wash liquor and includes ingredients which contribute to the washing effectiveness of the composition e.g. surfactants, Builders, bleaches, optical brighteners, buffers, enzymes and anti-redeposition agents, and also anti-corrosives but excludes water, solvents, dyes, perfume, Hydrotropes, sodium chloride, sodium sulphate, solubilisers and stabilisers whose sole function is to impart stability, fluidity or other desirable characteristics to a concentrated formulation. "Payload", means the percentage of Functional Ingredients based on the total weight of the composition. "Active Ingredients", means surface active materials.

All references herein to "Centrifuging", unless stated to the contrary are to be construed as referring to centrifuging at 25° C. for 17 hours at 800 times normal gravitational force;

The expression "Separable Phase" is used herein to denote phases which, in the case of liquid or liquid crystal phases, are separable from the mixture to form a distinct layer upon Centrifuging and, in the case of solid phases, are separable from the liquid phases, but not necessarily from each other, by Centrifuging. Unless the context requires otherwise all references to the composition of Separable Phases are references to the compositions of the centrifugally separated phases and references to the structure of a composition relate to the uncentrifuged composition. A single Separable Phase may comprise two or more thermodynamically distinct phases, which are not separable from each other on centrifuging as in, for example, a stable emulsion.

"Dispersed" is used herein to describe a phase which is discontinuously distributed as discrete particles or droplets in at least one other phase. "Co-continuous" describes two or more interpenetrating phases each of which extends continuously through a common volume, or else is formed of discreet elements which interact to form a continuous matrix tending to maintain the position and orientation of each element in relation to the matrix when the system is at rest. "Interspersed" describes two or more phases which are either Co-continuous or of which one or more is Dispersed in the other or others.

References to solid phases are to substances actually present in the composition in the solid state at ambient temperature, and including any water of crystallization or hydration unless the context requires otherwise. References to solids include references to microcrystalline and cryptocrystalline solids, i.e. solids whose crystals are not directly observed by optical microscopy but whose presence can only be inferred. A "Solid Layer" is a solid, pasty or non-pourable gelatinous layer formed on Centrifuging.

"Total Water" refers to water present as liquid water in a predominantly aqueous phase, together with any other water in the composition, e.g. water of crystallisation or hydration or water dissolved or otherwise present in any predominantly non-aqueous phase. "Dry Weight" refers to residual weight after removal of Total Water and also of any solvent which has a boiling point below 110° C.

The term "Formulation" is used to describe the combination of ingredients which make up the Dry Weight of a composition. Thus the same Formulation may be exemplified by a number of compositions, differing in their Percentage Dry Weight.

All references herein to viscosities unless otherwise stated are to the viscosity as measured on a cup and bob viscometer at 25° C. after two minutes running using a 20 mm internal diameter flat bottomed cup, 92 mm long, and a 13.7 mm diameter bob, 44 mm long, with conical ends having a 45° horizontal angle, and 4 mm diameter spindle, rotating at 350 rpm. The tip of the bob was 23 mm from the base of the cup This corresponds to Contraves "Rheomat 30" viscometer using measuring system C at speed setting 30. These conditions are unsuitable for measuring viscosities greater than 12 Pascal Seconds at which partial loss of contact between the bob and the sample may arise.

"Pourable" as used herein means having a viscosity of less than 11.5 Pascal Seconds.

"$L_1$" phase denotes a fluid, isotropic, micellar solution of surfactant in water, which occurs at concentrations between the critical micellar concentration and the first lyotropic mesophase, wherein the surfactant molecules aggregate to form spherical or rod shaped micelles.

"G" phase refers to a liquid crystal phase of the type, also known in the literature as "neat phase" or "lamellar phase" in which the surfactant molecules are arranged in parallel layers of indefinite extent separated by layers of water or an aqueous solution. The layers may be bilayers or interdigited layers of surfactant. The "G" phase for any given surfactant or surfactant mixture normally exists in a narrow range of concentrations. Pure "G" phases can normally be identified by examination of a sample under a polarising microscope, between crossed polarisers. Characteristic textures are observed in accordance with the classic paper by Resevear, JAOCS Vol. 31 P628 (1954) or in J. Colloid and Interfacial Science, Vol. 30 No. 4, P.500 (1969).

Yield points whenever referred to herein are as measured on an RML Series II Deer Rheometer at 25° C.

All percentages, unless otherwise stated, are by weight, based upon the total weight of the composition.

Reference herein to "sedimentation" include references to upward as well as downward separation of solid particles. "Non-sedimenting" means non-sedimentary under normal conditions of storage unless otherwise stated. Typically "Non-Sedimenting" implies no significant sedimentation after three months at room temperature under normal earth gravity. The term does not exclude compositions which show a degree of syneresis, whereby a part of the aqueous phase separates to form a clear layer external to a homogeneous gel or dispersion. Such partly separated systems can usually be dispersed by shaking. This is in contrast to sedimented systems wherein a solid sediment separates from the dispersion, which generally presents substantially greater problems in Dispersing and dispensing the product.

TECHNICAL BACKGROUND

Liquid detergents have hitherto been used mainly for light duty applications such as dish washing. The market for heavy duty detergents, e.g. laundry detergents, has been dominated by powders, due to the difficulty of getting an effective amount of surfactant and in particular of Builder into a stable liquid formulation. Such liquids should in theory be cheaper than powder detergents since they would avoid the need to dry and would in many instances replace the sulphate filler conventionally used in powder detergents with water. They also offer the possibilities of greater convenience and more rapid dissolution in wash water than powder. Attempts to provide solutions of the Functional Ingredients have been relatively unsuccessful commercially. One reason for this lack of success has been that the most commonly used and cost effective Functional Ingredients, e.g. sodium tripolyphosphate and sodium dodecyl benzene sulphonate, are insufficiently soluble in aqueous formulations. Potassium pyrophosphate and amine salts of the Active Ingredients which are more soluble, have been tried as alternatives but have not been found cost effective.

Unbuilt liquid detergents containing high levels of surfactant have been marketed for laundry use, but are unsuitable for hard water areas and have enjoyed only limited success.

A different approach is to attempt to suspend the excess Builder as a solid in the liquid solution of surfactant. The problem however has been to stabilise the system to maintain the Builder in suspension and prevent sedimentation. This has in the past required relatively sophisticated formulations, preventing realisation of the potential cost saving, and relatively low concentrations of solid Builder, giving limited washing effectiveness. This approach has been conditioned by certain assumptions: that the detergent should as far as possible be in solution; that the amount of suspended solid should be minimised to avoid difficulties in stabilising the suspension against sedimentation; and that special thickeners or stabilisers were essential to prevent sedimentation.

The products hitherto introduced commercially have suffered from certain serious drawbacks. In particular, the individual formulations have been proved highly sensitive to relatively small variations in composition and manufacturing procedure. Departure from a particular composition, optimised within fairly narrow limits, generally results in instability and diminished shelf life. The formulator has therefore been restricted to particular ingredients and proportions, which have not included many of the most effective combinations of surfactants and Builder for laundry purposes.

Because no general adequate theoretical explanation for the stability of such systems has been proposed, it has not proved possible to predict which formulations will be stable and which unstable, or how to set about stabilising any given surfactant Builder combination which may be desired for reasons of washing effectiveness or cost. Each formulation has had to be discovered by trial and error, and little flexibility has existed for adapting the individual formulations to special requirements.

Moreover, in general, the Payload had been undesirably low. In addition, the proportion of Builder to Active Ingredient has generally been less than is preferred for optimum washing, and expensive ingredients, not usually required in powder formulations, have often been needed to increase the amount of Functional Ingredient in solution, and to inhibit sedimentation of the suspended solid.

INTRODUCTION TO THE INVENTION

We have now discovered that by observing certain conditions it is possible to formulate Non-sedimenting, Pourable, fluid, aqueous based detergent compositions which have novel structural features and which can employ as surfactant virtually any surfactant or surfactant combination which is useful in laundry applications, in desired optimum proportions with any of the commonly used detergent Builders. In general, compositions of our invention can be obtained, which contain substantially higher Payloads at effective Builder to surfactant ratio than have hitherto been attainable.

Preferred embodiments of our invention exhibit at least some of the following advantages compared with products marketed hitherto: Higher Payload; increased Builder to surfactant ratio; improved stability; lower cost due to use of cheaper ingredients and ease of production; satisfactory mobility; improved washing performance; "non-drip" characteristics, permitting the compositions to be added to the compartments of washing machines designed to operate with powders, without premature release; a consistency suitable for automatic dispensing; and the flexibility to select optimum surfactant combinations for the requirements of any particular market.

We have found that in general, contrary to what had been assumed in the art, the higher the amount of undissolved material the more stable the composition. We have discovered, in particular, that the lower the proportion of the Active Ingredients dissolved in the liquid aqueous phase, and the higher the proportion present as a Interspersed structure of solid or lamellar phase, the more readily can a Non-sedimenting, Pourable product be obtained at high Payloads. We have further discovered that most surfactants commonly used in powder detergents can have a stabilising effect on aqueous suspensions of Functional Ingredients, when present in certain novel structured states in the composition, which may, at high Payloads, be sufficient to stabilise the composition without the presence of special stabilisers, not otherwise required for the formulation. We have also discovered that surfactants can be constrained to form an open three dimensional structure conferring stability on aqueous suspensions, by the presence of Electrolytes and by controlling the conditions of mixing. We have discovered that by applying the above principles it is possible to formulate laundry detergents as thixotropic gels having a matrix of hydrated solid or liquid crystal surfactant which may contain suspended particles of solid Builder, which have particular advantages over conventional detergent suspensions.

THE PRIOR ART

The prior art on liquid detergents is extremely voluminous. However, for the purpose of this invention the numerous references to light duty liquids and to unbuilt or built clear liquid laundry detergents in which all ingredients are present in solution may be disregarded. The Builder level in each case is substantially less than desirable.

Recent general summaries of the current state of the art include JAOCS (April 1981) P356A—"Heavy Duty Laundry Detergents" which includes a review of the typical commercially available liquid formulations, and "Recent Changes in Laundry Detergents" by Rutkowski, published in 1981 by Marcel Dekker Inc. in the Surfactant Science Series.

The two principle avenues of approach to the problem of formulating fully built liquid detergents, have been to emulsify a surfactant in an aqueous solution of Builder or to suspend a solid Builder in an aqueous solution or emulsion of surfactant.

The former approach is exemplified by U.S. Pat. No. 3,235,505, U.S. Pat. No. 3,346,503, U.S. Pat. No. 3,351,557, U.S. Pat. No. 3,509,059, U. S. Pat. No. 3,574,122, U.S. Pat. No. 3,328,309 and Canadian Pat. No. 917,031. In each of these patents an aqueous solution of a water soluble Builder is sufficiently concentrated to salt out the surfactant (usually a liquid non-ionic type) and the latter is dispersed in the aqueous medium as colloidal droplets, with the aid of various emulsifiers. In each case the system is a clear emulsion, which generally, contains relatively low levels of Builder, and which is undesirably expensive due to the cost of using soluble Builders.

The alternative approach is exemplified by B.P.948617, B.P.943271, B.P.2028365, E.P.38101, Australian P.522983, U.S. Pat. Nos. 4,018,720, 3,232,878, 3,075,922 and 2,920,045. The formulations described in these patents separate, on Centrifuging, into a Solid Layer comprising the majority of the sparingly soluble Builder and an aqueous Layer containing at least the majority of the Active Ingredients. Commercial products corresponding to examples of two of these patents have been marketed recently in Australia and Europe. The stability of these compositions is generally highly sensitive to minor variations in Formulation. Most require expensive additives which are not Functional Ingredients.

A different approach is to suspend solid builder in an anhydrous liquid non-ionic surfactant e.g. BP 1600981. Such systems are costly, restrictive with regard to choice of surfactant and give unsatisfactory rinsing properties.

Several patents describe emulsions in which the Builder is in the dispersed phase of an emulsion rather than in suspension. U.S. Pat. No. 4,057,506 describes the preparation of clear emulsions of sodium tripolyphosphate, and U.S. Pat. No. 4,107,067 describes inverse emulsions in which an aqueous solution of Builder is dispersed in a liquid crystal surfactant system.

Reference may also be made to the numerous patents relating to hard surface cleaners, in which an abrasive is suspended usually in an aqueous solution of surfactant, e.g. U.S. Pat. Nos. 3,281,367 and 3,813,349. U.S. Pat. No. 3,956,158 describes suspensions of abrasive in a gel system of interlocking fibres of, e.g. asbestos or soap. However, the low levels of surfactant, absence of Builder and presence of high concentrations of abrasive, generally preclude these patents from being of any assistance in the formulating of laundry detergents.

Powder detergents are normally prepared by spray drying aqueous slurries, which may superficially resemble liquid detergent formulations, but which are not required to be stable to storage, and which, are prepared and handled at elevated temperatures. Such slurries are generally not Pourable at ambient temperature. Patents describing the preparation and spray drying of such slurry intermediates include U.S. Pat. No. 3,639,288 and W. German OLS 1567656.

Other publications of possible interest are:

Australian patent 507431, which describes suspensions of Builder in aqueous surfactant, stabilised with sodium carboxymethyl cellulose or clay as a thickening agent. However, the levels of Functional Ingredients, and in particular of Builder, in the formulations exemplified, are not sufficient for a fully acceptable commercial product;

U.S. Pat. No. 3,039,971 describes a detergent paste containing the Builder in solution;

Fr. Pat. No. 2,839,651 describes suspensions of zeolite Builders in nonionic surfactant systems; the compositions are, however, stiff pastes rather than Pourable fluids.

A.C.S. Symposium series No. 194 "Silicates in Detergents" describes the effect of silicates on liquid detergents.

It will be understood that each of the foregoing patent references was selected from the very extensive prior art, and relevant aspects highlighted with the aid of hindsight, using our knowledge of the invention as a guide to such selection and highlighting. The ordinary man skilled in the art at the time of our first claimed priority, and withought foreknowledge of the applicant's invention, would not necessarily have selected those patents as being particularly significant or those aspects as being of special interest or relevance.

The foregoing summary does not therefore represent the overall picture of the art possessed by the ordinary skilled man. We believe that the latter has generally held the view, either that fully built liquid detergents containing sparingly soluble Builders were unattainable, or that progress towards such formulations would be by suspending the Builder in aqueous solutions of the surfactant, earlier, alternative approaches having failed.

THE INVENTION

Our invention provides Non-sedimenting, Pourable, fluid detergent compositions comprising Active Ingredients and Dispersed solid Builder said compositions comprising a predominantly aqueous liquid Separable Phase containing less than 75% by wt. of the Active Ingredient all of which compositions exhibit at least some, but not necessary all, of the following characteristics: They are thixotropic, they comprise at least one predominantly aqueous liquid phase and one or more other phases separable from said predominantly aqueous liquid phase by Centrifuging and containing Active Ingredient present in at least one of said one or more other phases, and a Builder, present in at least one of said one or more other phases, said one or more other phases being Interspersed with the predominantly aqueous phase; they are gels; they comprise a continuous, at least predominantly aqueous Separable Phase, containing dissolved Electrolyte, a solid or liquid crystal Separable Phase containing a substantial proportion of the Active Ingredient, Interspersed with said at least predominantly aqueous phase, and a Dispersed solid phase consisting at least predominantly of Builder; They have an organic lamellar component; said lamellar component comprises layers of surfactant and aqueous solution; said layers repeat at intervals of 20 to 65 Angstrom; said one or more other phases are at least predominantly non-aqueous; the compositions have a high Payload of Functional Ingredients, typically greater than 20% by weight, e.g. 25 to 75%, more usually at least 30% preferably at least 35% most preferably at least 40% by weight; they contain a high ratio of Builder to Active Ingredient e.g. greater than 1:1 preferably 1.2:1 to 4:1; they contain more than 5 and preferably more than 8% by weight of Active Ingredients; the predominantly aqueous phase contains a concentration of less than 15%, preferably less than 8%, e.g. less than 2%, typically, in the case of nonionic surfactant or alkyl benzene sulphonates, less than 0.5% by weight dissolved Active Ingredients; the proportion by weight of Active Ingredient in the predominantly aqueous phase to total Active Ingredient in the composition is less than 1:1.5 preferably less than 1:2 e.g. less than 1:4; the at least one predominantly aqueous liquid phase contains sufficient electrolyte to provide a concentration of at least 0.8 preferably at least 1.2 e.g. 2.0 to 4.5 gram ions per liter of total alkali metal and/or ammonium cations; the compositions contain at least 15% by weight, preferably more than 20% by weight of Builder; the Builder is at least predominantly sodium tripolyphosphate; the Builder comprise a minor proportion of alkali metal silicate, preferably sodium silicate; the bulk viscosity of the composition is between 0.1 and 10 pascal seconds, preferably between 0.5 and 5 pascal seconds; the composition has a yield point preferably of at least 2 e.g. at least 5, preferably less than 200 e.g. 10 to 150 dynes/sq.cm; a phase containing Builder comprises solid particles having a maximum particle size below the limit at which the particles tend to sediment; the paticles have, adsorbed on their surfaces at least one crystal growth inhibitor sufficient to maintain the solid particles below the limit at which the particles tend to sediment; the composition contains an agglomeration inhibitor sufficient to prevent flocculation or coagulation of the solid particles.

According to one embodiment, therefore, our invention provides a Pourable, Non-sedimenting, aqueous based detergent composition having at least 25% by weight Payload and comprising a first predominantly aqueous liquid phase, containing dissolved electrolyte, at least one Dispersed solid phase comprising solid Builder, and at least one other phase, comprising more than 25% of the Active Ingredients which is separable from said first phase by Centrifuging at 800 times normal earth gravity for 17 hours at 25° C.

According to a second embodiment, our invention provides a Pourable, Non-sedimenting, aqueous based detergent composition comprising water, at least 5% by weight of surfactant and at least 16% by weight of Builder, which on centrifuging at 800 times normal gravity for 17 hours at 25° C. provides a predominantly aqueous liquid layer containing dissolved Electrolyte and one or more other layer, said one or more other layers containing at least a proportion of said Builder as a solid and at least a major proportion of said surfactant.

According to a third, embodiment our invention provides a Pourable, Non-sedimenting, aqueous based, detergent composition having an organic lamellar structural component and comprising a predominantly aqueous liquid Separable Phase containing dissolved Electrolyte, a Separable Phase comprising at least a substantial proportion of surfactant, Interspersed with said predominantly aqueous Separable phase, and at least one solid phase consisting, at least predominantly of solid particles of Builder, Dispersed in the other phases, said composition having a Payload of at least 25%.

According to a fourth embodiment, our invention provides Non-sedimenting, Pourable, fluid, detergent compositions having a Payload of at least 25% by weight and comprising: at least one predominantly aqueous liquid Separable Phase; and one or more other Seperable Phases, at least one of which latter phases comprises a matrix of solid surfactant hydrate which forms with said predominantly aqueous liquid phase or phases a thixotropic gel; and suspended particles of solid Builder.

According to a fifth embodiment, our invention provides Non-sedimenting, pourable, fluid detergent compositions, comprising at least one predominantly aqueous liquid Separable Phase, at least one liquid crystal Separable Phase containing surfactant and at least one predominantly non-aqueous Separable Phase which comprises particles of solid Builder suspended in said composition. Preferably the liquid crystal phase is a "G" phase.

According to a sixth embodiment, our invention provides a Non-sedimenting, Pourable, fluid, built, detergent composition comprising at least one predominantly aqueous Separable Phase and one or more other Seperable Phases; at least one of said other phases, comprises spheroids or vessicles formed from one or more shells of surfactant. Said shells of surfactant may optionally be separated by shells of water or aqueous solution providing a lamellar e.g. "G" Phase structure. Said vessicles may contain a predominantly aqueous liquid phase, and/or one or more spherical or rod shaped surfactant micelles and/or one or more particles of solid Builder.

According to a seventh embodiment the invention provides a Non-sedimenting, Pourable, fluid, detergent composition comprising a first predominantly aqueous, liquid Separable Phase containing, dissolved therein, less the 60% of the total weight of Active Ingredients in the Composition; and one or more other Separable Phases, Interspersed therewith, at least one of said other phases containing anionic and/or nonionic Active Ingredients and at least one of said other phases containing solid Builder.

According to an eighth embodiment, the invention provides a Non-sedimenting, Pourable, fluid, built, detergent composition, comprising at least one, predominantly aqueous, liquid Separable Phase containing sufficient Electrolyte dissolved therein to provide at least 0.5 preferably at least 0.8 e.g. 1 to 4 gram ions per liter of total alkali metal, alkaline earth metal and/or ammonium cations, and one or more other phases, containing surfactant, Interspersed therewith, and a suspended solid Builder, said composition having a Payload of at least 25% by weight, said Electrolyte being present in at least sufficient amount to maintain at least a major proportion of the total Active Ingredients of the composition in at least one of said other phases, and thereby inhibiting sedimentation of said Builder.

According to a ninth embodiment the invention provides a Non-sedimenting, Pourable, fluid detergent composition comprising at least one predominantly aqueous liquid Separable Phase, containing dissolved Electrolyte, at least one other Separable Phase containing Active Ingredients; and suspended solid builder; said composition having a Pay Load between the minimum concentration to provide a Non-sedimenting composition and the maximum concentration to provide a Pourable composition.

According to a further embodiment, our invention provides a Non-sedimenting Pourable, fluid, detergent composition comprising at least one predominantly aqueous Separable Phase substantially saturated with respect to each of at least one surfactant capable of forming a solid hydrate or liquid crystal phase, and at least one Builder, a matrix of said solid hydrate, or liquid crystal, surfactant Interspersed with said predominantly aqueous phase having suspended therein particles of said at least one Builder of a size below the threshold at which sedimentation occurs, said composition comprising a particle growth inhibitor sufficient to maintain said particles below said threshold and an agglomeration inhibitor sufficient to prevent coagulation of said particles. Preferably the Dry Weight content in said further embodiment is greater than 35% by weight of the composition and the ratio of Builder to Active Ingredients is greater than 1:1.

CLASSIFICATION BY CENTRIFUGING

Aqueous based liquid laundry detergents containing suspended solid builder can, in general, conveniently be classified by Centrifuging as hereinbefore defined.

Three principal types of laundry liquid having a continuous aqueous phase and dispersed solid are distinguishable, which will be hereinafter referred to as Group I, Group II and Group III suspensions.

The first Group of laundry suspensions is characteristic of the prior art discussed above which relates to suspensions of solid Builder in aqueous solutions or emulsions of surfactant. On centrifuging as defined herein, Group I compositions separate into a Solid Layer consisting essentially of Builder, and a viscous liquid layer comprising water and surfactant. Formulation factors tending to form Group 1 compositions include the use of the more water soluble surfactants, such as alkyl ether sulphates, the presence of solubilising agents such as Hydrotropes and water miscible organic solvents, relatively low levels of Electrolyte and relatively low Pay Loads. Group 1 formulations normally display at least some of the following typical properties. The bulk viscosity of the composition is determined by, and is similar to, the viscosity of the aqueous liquid layer. The aqueous layer typically has a viscosity of from 0.1–1.0 pascal seconds. Viscosities of the compositions are generally also under 1 pascal second, e.g. 0.3 to 0.6 pascal seconds. The compositions usually have yield points of less than 4, often less than 1, dyne $cm^{-2}$. This implies a relatively unstructured composition. This is confirmed by neutron scattering and x-ray diffraction studies and by electron microscopy. Subjection to high shear rate renders many Group I formulations unstable.

Group II is essentially distinguished from Group I in that at least the major proportion of the surfactant is present in a Separable Phase, which is distinct from the predominantly aqueous liquid phase containing the Electrolyte. This Group is distinguished from Group III in that at least the major portion of the surfactant separates on centrifuging as a liquid or liquid crystal layer.

Group II is not represented in the prior art, but is typical of those laundry detergents of our invention which are prepared from nonionic or some mixed nonionic/anionic surfactants as the major constituent of the Active Ingredients. Group II compositions typically show a three layer separation on centrifuging, giving a non-viscous liquid aqueous layer (e.g. less than 0.1 pascal seconds, usually less than 0.02 pascal seconds), which contains Electrolyte but little or no surfactant, a viscous liquid layer which contains a major proportion of the Active Ingredients and a Solid Layer consisting predominantly of Builder. Group II compositions have, typically, a very low yield point on being first prepared but become more gel like on ageing. The viscosity of the composition is usually between 1 and 1.5 pascal seconds. The compositions of this type show evidence of lamellar structure in X-ray and neutron diffraction experiments and by electron microscopy. Most centrifuged Group II compositions have the liquid or liquid crystal surfactant layer uppermost, but we do not exclude compositions in which the aqueous Electrolyte layer is uppermost or in which there are two or more Solid Layers distinguishable from each other, at least one of which may sediment upwardly, in relation to either or both liquid layers on centrifuging.

The essential distinction of Group III from the other Groups is that at least the majority of the surfactant Centrifuges into a Solid Layer. Group III formulations may centrifuge into more than one Solid Layer. Normally both surfactant and Builder sediment downwardly on Centrifuging and the two solid phases are intermixed. However some Group III formulations may provide an upwardly sedimentary surfactant phase or more than one surfactant phase at least one of which may sediment upwardly. It is also possible for some or all of the Builder to sediment upwardly.

The third Group of laundry liquids is typical of those compositions of the present invention prepared from those surfactants which are more sparingly soluble in the aqueous phase, especially anionic surfactants such as sodium alkyl benzene sulphonates, alkyl sulphates, carboxylic ester sulphonates and many soaps, as well as mixtures of such surfactants with minor proportions of non-ionic surfactant. Group III formulations typically separate on centrifuging into two Layers. The first of which is a non-viscous aqueous Layer (e.g. less than 0.1 pascal seconds, and usually less than 0.02 pascal seconds) containing dissolved electrolyte and little or no surfactant, and the second is a Solid Layer comprising Builder and surfactant.

The rheological properties of Group III, typically, show the strongest evidence for structure. The viscosity of the suspension is substantially greater than that of the aqueous Layer, e.g. typically 1.2 to 2 Pascal seconds The compositions generally have a fairly high yield point, e.g. greater than 10 dynes $cm^{-2}$ and a very short recovery time after subjection to shear stresses in excess of the yield point, e.g. usually 20 to 100 minutes. On recovery after subjection to very high shear stresses many Group III formulations exhibit increased viscosity and greater stability.

There is gradual progression from Group I to Group III with some formulations having some properties characteristic of one group and some characteristic of another. Soap based formulation of our invention, for example, may show, in addition to a liquid and a solid layer, a small amount of a third layer which is liquid, on centrifuging but have rheological properties characteristic of Group III.

Compositions at the borderline of Groups I and II are sometimes unstable but maybe converted into stable Group II Formulations of the innvention by addition of sufficient Electrolyte and/or by increasing Pay Load. Most Group I Formulations may be converted into Group II if sufficient Electrolyte is added. Similarly, addition of more Electrolyte tends to convert Group II formulations into Group III. Conversely, Group III can generally be converted to Group II, and Group II to Group I, by addition of Hydrotrope. We do not exclude the possibility that some Group III formulations may be converted directly to Group I and vice versa by addition of Hydrotrope or Electrolyte respectively.

CLASSIFICATION BY DIFFRACTION AND MICROSCOPY

Formulations of our invention and of the prior art, have been examined by x-ray and neutron diffraction and by electron microscopy.

Samples for neutron diffraction studies were prepared using deuterium oxide in place of water. Water was kept to a minimum, although some ingredients, normally added as aqueous solutions (e.g. sodium silicate), or as hydrates, were not available in a deuterated form.

Deuterium oxide based formulations were examined on the Harwell small angle Neutron Scattering Specrometer. Both deuterium oxide based and aqueous samples were also examined using a small angle x-ray diffractometer. Aqueous samples were freeze fracture etched, coated with gold or gold/paladium and studied under the Lancaster University Low Temperature Scanning Electron Microscope. Competititve commercial formulations, which are not, of course, available in a deuterated form, could not be examined by neutron scattering.

As in the case of centrifuging, the three techniques described above all provide an indication of three broad categories of liquid detergent suspension, which appear to correspond generally to the Group I, Group II and Group III compositions, described under "Classification by Centrifuging".

The first category of composition, which included, generally those compositions belonging typically to Group I, was characterised under both neutron and x-ray analysis by high levels of small angle scattering and an absence of discrete peaks, corresponding to regular, repeating, structural features. Some formulations showed broad indistinct shoulders or humps, others a smooth continuum.

Small angle scattering is scattering very close to the line of the incident beam and is usually dominated by scattering from dilute dispersions of inhomogeneities in the composition. The shoulders or humps observed with some Group I formulations additionally show a form and angular displacement typical of concentrated micellar solutions of surfactant ($L_1$ phase). Under the electron microscope typical Group 1 formulations gave a largely featureless granular texture with crystals of Builder distributed apparently at random. These results were consistent with the hypothesis based on their rheological properties that typical Group I formulations are relatively unstructured and lacking detectable lamellar features. However some members of Group I showed evidence under the electron microscope of spherical structures of approximately 5 microns diameter.

A very different type of pattern was obtained from typical Group II formulations. These showed relatively low levels of small angle scattering near the incident beam, a peak typical of concentrated micellar solution ($L_1$ phase) and a sharply defined peak or peaks corresponding to a well defined lamellar structure. The positions of the latter peaks were in a simple numerical ratio, with first, second and, sometimes, third order peaks usually distinguishable. The peaks were evidence of relatively broadly spaced lamellae (36–60 Angstrom). Under the electron microscope lamellar structures were visible. In some instances spheroidal structures could also be observed e.g. of approximately 1 micron diameter.

Typical Group III formulations gave relatively narrow and intense small angle scattering, together with distinct peaks indicative of a lamellar structure. The peaks were broader than in the case of typical Group II formulations, and second and third order peaks were not always separately distinguishable. In general the displacement of the peaks indicated a lamellar structure with the lamellae more closely spaced than in the case of typical Group II formulations (e.g. 26–36 Angstrom). Lamellar structures were clearly visible under the electron microscope.

PROPOSED STRUCTURE

We believe that the foregoing properties can most readily be explained by the hypothesis that our invention embodies a novel structure of matter in which solid Builder is suspended in a structured arrangement of solid surfactant hydrate, and/or of "G" phase surfactant in association with an $L_1$ phase micellar solution.

Preferred embodiments of our invention and in particular, Group III compositions, are believed to comprise pourable gel systems in which there may be two or more Co-continuous or Interspersed phases. The properties of the Group III compositions can be explained on the basis that they are thixotropic gels comprising a relatively weak three dimensional network of solid surfactant hydrate Interspersed with a relatively non viscous aqueous phase which contains dissolved Electrolyte, but little or no surfactant. The network prevents sedimentation of the network-forming solids, and any suspended discrete particles. The network forming solids may be present as platelets, sheets of indefinite extent, or fibres or alternatively, as asymetric particles joined into or interacting to provide, a random mesh, which is Interspersed with the liquid. The structure is sufficiently stable to inhibit or prevent precipitation on storage and will also limit the extent of spreading of the gel on a horizontal surface, however the structure is weak enough to permit the compositions to be poured or pumped. The solid structure is composed at least predominantly of surfactant hydrate e.g. sodium alkyl benzene sulphonate or alkyl sulphate. Thus no other stabilising agent is required over that required in the end-use of the formulation. Such gels may, in particular, exhibit a clay-like structure, sometimes referred to as a "house of cards" structure, with a matrix of plate shaped crystals orientated at random and enclosing substantial interstices, which accomodate the particles of builder. The solids surfactant may, in some instances be associated with, or at least partially replaced by "G" phase surfactant.

In the case of Group II compositions there may be four thermodynamically distinct phases of which only three are Separable Phases under the conditions herein defined.

The phases detected by diffraction comprise a lamellar phase, which is probably a "G" phase, but possibly in some instances surfactant hydrate or a mixture thereof with "G" phase, and predominantly aqueous "$L_1$" micellar solution, together with the solid Builder. There is also a predominantly aqueous solution containing electrolyte but less than 75% particularly 50%, usually less than 40%, more usually less than 20% preferably less than 10% more preferably less than 5% e.g. less than 2% of the total weight of Active Ingredients.

The builder is suspended in a system which may comprise a network of "G" phase and/or spheroids or vessicles, which may have an onion like structure, or outer shell, formed from successive layers of surfactant e.g. as "G" phase, and which may contain at least one of the predominantly aqueous phases, e.g. the electrolyte solution, or more probably the "$L_1$" micellar solution. At least one of the predominantly aqueous phases is the continuous phase. Evidence for the presence of vessicles is provided by microscopy in the case of the compositions containing olefin and paraffin sulphonates.

SURFACTANTS

The compositions of our invention preferably contain at least 5% by weight of surfactants. Preferably the surfactant constitutes from 7 to 35% by weight of the composition, e.g. 10 to 20% by weight.

The surfactant may for example consist substantially of an at least sparingly water-soluble, salt of sulphonic or mono esterified sulphuric acids e.g. an alkylbenzene sulphonate, alkyl sulphate, alkyl ether sulphate, olefin sulphonate, alkane sulphonate, alkylphenol sulphate, alkylphenol ether sulphate, alkylethanolamide sulphate, alkylethanolamide ether sulphate, or alpha sulpho fatty acid or its esters each having at least one alkyl or alkenyl group with from 8 to 22, more usually 10 to 20, aliphatic carbon atoms. Said alkyl or alkenyl groups are preferably straight chain primary groups but may optionally be secondary, or branched chain groups. The expression "ether" hereinbefore refers to polyoxyethylene, polyoxypropylene, glyceryl and mixed polyoxyethylene-oxy propylene or mixed glyceryloxyethylene or glyceryl-oxy propylene groups, typically containing from 1 to 20 oxyalkylene groups. For example, the sulphonated or sulphated surfactant may be sodium dodecyl benzene sulphonate, potassium hexadecyl benzene sulphonate, sodium dodecyl dimethyl benzene sulphonate, sodium lauryl sulphate, sodium tallow sulphate, potassium oleyl sulphate, ammonium lauryl monoethoxy sulphate, or monoethanolamine cetyl 10 mole ethoxylate sulphate.

Other anionic surfactants useful according to the present invention include fatty alkyl sulphosuccinates, fatty alkyl ether sulphosuccinamates, fatty alkyl sulphosuccinamates, fatty alkyl ether sulphosuccinamates, acyl sarcosinates, acyl taurides, isethionates, Soaps such as stearates, palmitates, resinates, oleates, linoleates, and alkyl ether carboxylates. Anionic phosphate esters may also be used. In each case the anionic surfactant typically contains at least one aliphatic hydrocarbon chain having from 8 to 22 preferably 10 to 20 carbon atoms, and, in the case of ethers one or more glyceryl and/or from 1 to 20 ethyleneoxy and or propyleneoxy groups.

Certain anionic surfactants, such as olefin sulphonates and paraffin sulphonates are commercially available only in a form which contains some disulphonates formed as by-products of the normal methods of industrial manufacture. The latter tend to solubilise the surfactant in the manner of a Hydrotope. However, the olefin and paraffin sulphonates readily form stable compositions which, on centrifuging, contain a minor portion of the total surfactant in the aqueous phase, and which show evidence of spheroidal structures. These compositions are valuable, novel, laundry detergents and which accordingly constitute a particular aspect of the present invention.

Preferred anionic surfactants are sodium salts. Other salts of commercial interest include those of potassium, lithium, calcium, magnesium, ammonium, monoethanolamine, diethanolamine, triethanolamine and alkyl amines containing up to seven aliphatic carbon atoms.

The surfactant may optionally contain or consist of nonionic surfactants. The nonionic surfactant may be e.g. a $C_{10-22}$ alkanolamide of a mono or di-lower alkanolamine, such as coconut monoethanolamide. Other nonionic surfactants which may optionally be present, include ethoxylated alcohols, ethoxylated carboxylic acids, ethoxylated amines, ethoxylated alkylolamides, ethoxylated alkylphenols, ethoxylated glyceryl esters, ethoxylated sorbitan esters, ethoxylated phosphate esters, and the propoxylated or ethoxylated and propoxylated analogues of all the aforesaid ethoxylated nonionics, all having a $C_{8-22}$ alkyl or alkenyl group and up to 20 ethyleneoxy and/or propyleneoxy groups, or any other nonionic surfactant which has hitherto been incorporated in powder or liquid detergent compositions e.g. amine oxides. The latter typically have at least one $C_{8-22}$, preferably $C_{10-20}$ alkyl or alkenyl group and up to two lower (e.g. $C_{1-4}$, preferably $C_{1-2}$) alkyl groups.

The preferred nonionics for our invention are for example those having an HLB range of 7–18 e.g. 12–15.

Certain of our detergents may contain cationic surfactants, and especially cationic fabric softeners usually as a minor proportion of the total active material. Cationic fabric softeners of value in the invention include quaternary amines having two long chain (e.g. $C_{12-22}$ typically $C_{16-20}$) alkyl or alkenyl groups and either two short chain (e.g. $C_{1-4}$) alkyl groups, or one short chain and one benzyl group. They also include imidazoline and quaternised imidazolines having two long chain alkyl or alkenyl groups, and amido amines and quaternised amido amines having two long chain alkyl or alkenyl groups. The quaternised softeners are all usually salts of anions which impart a measure of water solubility such as formate, acetate, lactate, tartrate, chloride, methosulphate, ethosulphate, sulphate or nitrate. Compositions of our invention having fabric softener character may contain smectite clays.

Compositions of our invention may also contain amphoteric surfactant, which may be included typically in surfactants having cationic fabric softener, but may also be included, usually as a minor component of the Active Ingredients, in any of the other detergent types discussed above.

Amphoteric surfactants include betaines, sulphobetaines and phosphobetaines formed by reacting a suitable tertiary nitrogen compound having a long chain alkyl or alkenyl group with the appropriate reagent, such as chloroacetic acid or propane sultone. Examples of suitable tertiary nitrogen containing compounds include: tertiary amines having one or two long chain alkyl or alkenyl groups, optionally a benzyl group and any other substituent such as a short chain alkyl group; imidazoline having one or two long chain alkyl or alkenyl groups and amidoamines having one or two long chain alkyl or alkenyl groups.

Those skilled in the detergent art will appreciate that the specific surfactant types described above are only exemplary of the commoner surfactants suitable for use according to the invention. Any surfactant capable of performing a useful function in the wash liquor may be included. A fuller description of the principal types of surfactant which are commercially available is given in "Surface Active Agents and Detergents" by Schwartz Perry and Berch.

BUILDERS

The Builder, in preferred compositions of our invention is believed to be normally present, at least partially, as discrete solid crystallites suspended in the composition. The crystallites typically have a size of up to 60 eg 5 to 50 microns.

We have found that Formulations containing sodium tripolyphosphate as Builder, or at least a major proportion of sodium tripolyphosphate in admixture with other Builders, exhibit stability and mobility over a wider range of Dry Weight than corresponding Formulations with other Builders. Such formulations are therefore preferred. Our invention, however, also provides compositions comprising other Builders such as potassium tripolyphosphate, carbonates, zeolites, nitrilo triacetates, citrates, metaphosphates, pyrophosphates, phosphonates, EDTA and/or polycarboxylates, optionally but preferably, in admixture with tripolyphosphate. Orthophosphates may be present, preferably as minor components in admixture with tripolyphosphate, as may alkali metal silicates.

The last mentioned are particularly preferred and constitute a feature of our preferred embodiments since they perform several valuable functions. They provide the free alkalinity desirable to saponify fats in the soil, they inhibit corrosion of aluminium surfaces in washing machines and they have an effect as Builders. In addition, they are effective as Electrolytes to "salt out" Active Ingredients from the predominantly aqueous liquid phase thereby reducing the proportion of Active Ingredient in solution and improving the stability and fluidity of the composition.

Accordingly, we prefer that compositions of our invention should contain at least 1% and up to 12.3% by weight of the composition preferably at least 2% and up to 10%, most preferably more than 3% and up to 6.5% e.g. 3.5 to 5% of alkali metal silicate, preferably sodium silicate measured as $SiO_2$ based on the total weight of composition.

Typically, the silicate used to prepare the above compostions has an $Na_2O:SiO_2$ ratio of from 1:1 to 1:2 to 1:1.5 to 1:1.8. It will however be appreciated that any ratio of $Na_2O$ (or other base) to $SiO_2$, or even silicic acid could be used to provide the silicate in the composition, and any necessary additional alkalinity provided by addition of another base such as sodium carbonate or hydroxide. Formulations not intended for use in washing machines do not require silicates provided that there is an alternative source of alkalinity.

The Builder normally constitutes at least 15% by weight of the compositions, preferably at least 20%. We prefer that the ratio of Builder to surfactant is greater than 1:1 preferably 1.2:1 to 5:1.

ELECTROLYTE

The concentration of dissolved organic material and more particularly of Active Ingredients in the predominantly aqueous, liquid phase is preferably maintained at a low level. This may be achieved by selecting, so far as possible, surfactants which are sparingly soluble in the predominantly aqueous phase, and keeping to a minimum the amount of any more soluble surfactant which is desired for the particular end use. For a given surfactant system and Payload, we have found that it is generally possible to stabilise the system in accordance with an embodiment of our invention by including in the at least one predominantly aqueous phase a sufficient quantity of Electrolyte.

An effect of the Electrolyte is to limit the solubility of Active Ingredient in the at least one predominantly aqueous phase, thereby increasing the proportion of surfactant available to provide a solid, or liquid crystal, matrix which stabilises the compositions of our invention. A further effect of the Electrolyte is to raise the transition temperature of the "G" phase to solid for the surfactant. One consequence of raising the phase transition temperature is to raise the minimum temperature above which the surfactant forms a liquid or liquid crystal phase. Hence surfactants which in the presence of water are normally liquid crystals or aqueous micellar solutions at ambient temperature may be constrained by the presence of Electrolyte to form solid matrices or "G" phases.

Preferably, the proportion of Electrolyte in the at least one predominantly aqueous phase is sufficient to provide a concentration of at least 0.8 preferably at least 1.2 e.g. 2.0 to 4.5 gram ions per liter of alkali metal alkaline earth metal and/or ammonium cations. The stability of the system may be further improved by ensuring so far as possible that the anions required in the composition are provided by salts which have a common cation, preferably sodium. Thus, for example, the preferred Builder is sodium tripolyphosphate, the preferred anionic surfactants are sodium salts of sulphated or sulphonated anionic surfactants and any anti-redeposition agent, e.g. carboxymethyl cellulose, or alkali, e.g. silicate or carbonate are also preferably present as the sodium salts. Sodium chloride, sodium sulphate or other soluble inorganic sodium salts may be added to increase the electrolyte concentration and minimise the concentration of Active Ingredients in the predominantly aqueous liquid phase. The preferred electrolyte, however, is sodium silicate. Alkaline earth metals are only normally present when the Active Ingredients comprise surfactants, such as olefin sulphonates or non-ionics which are tolerant of their presence.

It is possible, alternatively, but less preferably to choose salts of potassium, ammonium, lower amines, alkanolamines or even mixed cations.

We prefer that at least two thirds of the weight of the Functional Ingredients should be in a phase separable from the at least one predominantly aqueous liquid phase, preferably at least 75%, e.g. at least 80%.

The concentration of Active Ingredient in the predominantly aqueous liquid phase is generally less than 10% by weight, preferably less than 7% by weight, more preferably less than 5% by weight e.g. less than 2%. Many of our most effective formulations have a concentration of less than 1% Active Ingredient dissolved in the predominantly aqueous liquid phase e.g. less than 0.5%.

The concentration of dissolved solids in the predominantly aqueous liquid phase may be determined by separating a sample of the aqueous liquid, e.g. by Centrifuging to form an aqueous liquid layer and evaporating the separated layer to constant weight at 110° C.

STABILISING SUSPENDED SOLID

The particle size of any solid phase should be less than that which would give rise to sedimentation. The critical maximum limit to particle size will vary according to the density of the particles and the density of the continuous phase and the yield point of the composition.

Compositions of our invention preferably contain a particle growth inhibitor. The particle growth inhibitor is believed to function by adsorption onto the faces of suspended crystallites of sparingly soluble solids preventing deposition of further solid thereon from the saturated solution in the predominantly aqueous liquid phase. Typical particle growth inhibitors include sulphonated aromatic compounds. Thus for example, a sodium alkyl benzene sulphonate such as sodium dodecyl benzene sulphonate when present as a surfactant is itself a particle growth inhibitor and may be sufficient to maintain particles of, for example, builder in the desired size range without additional stabilisers. Similarly, lower alkyl benzene sulphonate salts such as sodium xylene sulphonate or sodium toluene sulphonate have stabilising activity, as well as being conventionally added to liquid detergents as Hydrotropes. In our invention, however, the presence of the lower alkyl benzene sulphonates is less preferred. Sulphonated naphthalenes especially methyl naphthalene sulphonates are effective crystal growth inhibitors. They are not, however, normal ingredients of detergent compositions and therefore on cost grounds they are not preferred. Other particle growth inhibitors include water soluble polysaccharide derivative such as sodium carboxymethyl cellulose, which is frequently included in detergent compositions as a soil anti-redeposition agent. We, therefore prefer that it should be present in minor amounts in compositions according to our invention, sufficient to perform its normal functions in detergent compositions and to assist in stabilising the suspension, but preferably not sufficient to increase so substantially the viscosity of the predominantly aqueous liquid phase as to impair the pourability of the composition.

Another group of particle growth inhibitors which may optionally be included in compositions according to our invention are the sulphonated aromatic dyes, especially the sulphonated aromatic optical brightening agents, which are sometimes included in powder formulations.

Typical examples include 4,4'-bis(4-phenyl-1,2,3-triazol-2-yl-2,2'-stilbene disulphonate salts and 4,4'-diphenylvinylene-2,2'-biphenyl disulphonate salts. Such particle growth inhibitors may be included instead of, or more usually in addition to, for example, a sulphonated surfactant.

Other effective particle growth inhibitors include lignosulphonates and $C_{6-18}$ alkane sulphonate surfactants, which latter compounds may also be present as part of the surfactant content of the composition.

The presence of an agglomeration inhibitor is also preferred. The agglomeration inhibitor for use according to our invention may also conveniently be sodium carboxymethyl cellulose. It is preferred that the composition should include an effective agglomeration inhibitor which is chemically distinct from the particle growth inhibitor, despite the fact that, for example, sodium carboxymethyl cellulose, is capable of performing either function. It is sometimes preferred, when preparing the detergent composition to add the crystal growth inhibitor to the composition prior to the agglomeration inhibitor, and to add the agglomeration inhibitor subsequent to the solid phase, so that the crystal growth inhibitor is first adsorbed onto the solid particles to inhibit growth thereof and the agglomeration inhibitor is subsequently introduced to inhibit agglomeration of the coated particles.

Other agglomeration inhibitors which may less preferably be used include polyacrylates and other polycarboxylates, polyvinyl pyrrolidone, carboxy methyl starch and lignosulphonates.

The concentration of the crystal growth inhibitor and agglomeration inhibitor can be widely varied according to the proportion of solid particles and the nature of the dispersed solid as well as the nature of the compound used as the inhibitor and whether that compound is fulfilling an additional function in the composition. For example, the preferred proportions of alkyl benzene sulphonate are as set out hereinbefore in considering the proportion of surfactant. The preferred proportions of sodium carboxy methyl cellulose are up to 2.5% by weight of the composition preferably 0.5 to 2% by weight e.g. 1 to 2% although substantially higher proportions up to 3 or even 5% are not excluded provided they are consistent in the particular formulation with a pourable composition. The sulphonated optical brighteners may typically be present in proportions of 0.05 to 1% by weight e.g. 0.1 to 0.3% although higher proportions e.g. up to 5% may less preferably be present in suitable compositions.

ALKALINITY

The compositions or our invention are preferably alkaline, being desirably buffered with an alkaline buffer adapted to provide a pH above 8 eg above 9 most preferably above 10 in a wash liquor containing the composition diluted to 0.5% Dry Weight. They preferably have sufficient free alkalinity to require from 0.4 to 12 mls. preferably 3 to 10 mls of N/10 HCl to reduce the pH of 100 mls. of a dilute solution of the composition, containing 0.5% Dry Weight, to 9, although compositions having higher alkalinity may also be commercially acceptable. In general lower alkalinities are less acceptable in commercial practice, although not excluded from the scope of our invention.

The alkaline buffer is preferably sodium tripolyphosphate and the alkalinity preferably provided at least in part by sodium silicate. Other less preferred alkaline buffers include sodium carbonate.

SOLUBILISERS

Hitherto, liquid detergent compositions have commonly contained substantial concentrations of Hydrotropes and/or organic water miscible hydroxylic solvents such as methanol, ethanol, isopropanol, glycol, glycerol, polyethylene glycol and polypropylene glycol. Such additives are often necessary to stabilise Group I formulations. However, in Group II and III formulations of the present invention, they may have a destabilising effect which often requires the addition of extra amounts of Electrolyte to maintain stability. they are, moreover, costly and not Functional Ingredients. They may, however, in certain circumstances, promote Pourability. We do not therefore totally exclude them from all compositions of our invention, but we prefer that their presence be limited to the minimum required to ensure adequate Pourability. If not so required we prefer that they be absent.

PAYLOAD

Selection of the appropriate Payload is generally important to obtain desired stability and Pourability. Optimum Payload may vary considerably from one type of Formulation to another. Generally speaking it has not been found possible to guarantee Non-sedimenting compositions below about 35% by weight Payload, although some types of Formulation can be obtained in a Non-sedimenting form below 30% Payload, and sometimes as low as 25% Payload. In particular we have obtained Soap based Formulations at concentrations below 25% Pay Load eg 24%. We do not exclude the possibility of making such Formulations at Pay Loads down to 20%.

Prior art references to stable compositions at low Payloads have either been limited to particular Formulations using special stabilisers, or have not provided sufficiently stable suspensions to satisfy normal commercial criteria.

For any given Formulation according to our invention a range of Payloads can be identified within which the composition is both stable and pourable. Generally below this range, sedimentation occurs and above the range the Formulation is too viscous. The acceptable range may be routinely determined for any given Formulation by preparing the suspension using the minimum water required to maintain a stirrable composition, diluting a number of samples to progressively higher dilutions, and observing the samples for signs of sedimentation over a suitable period. For some Formulations the acceptable range of Payloads may extend from 30% or 35% to 60 or even 70% by weight for others it may be much narrower, e.g. 40 to 45% by weight.

If no stable Pourable range can be determined by the above methods, the Formulation should be modified according to the teaching herein e.g. by the addition of more sodium silicate solution or other Electrolyte. Typically Group III formulations show an increase in yield point with increasing Pay Load. The minimum stable Pay Load for such typical Group III formulations usually corresponds to a yield Point of about 10–12 degrees/$cm^2$.

PREPARATION

Compositions of our invention can, in many instances be readily prepared by normal stirring together of the ingredients. However, some Formulations according to the invention are not fully stable unless the composition is subjected to more prolonged or vigorous mixing. In some extreme cases the solid content of product may require comminution in the presence of the liquid phase. The use of a colloid mill for the latter is not excluded, but is not generally necessary. In some instances mixing under high shear rate provides products of high viscosity.

The order and conditions of mixing the ingredients are often important in preparing a stable structured mixture according to our invention. Thus a system comprising: water, sodium dodecylbenzene sulphonate, coconut monethanolamide, sodium tripolyphosphate, sodium silicate, sodium carboxymethyl cellulose and optical brightener at 45% Dry Weight was unstable when the compounds were mixed in the order described above, but when mixed with the coconut monoethanolamide and sodium tripolyphosphate added as the last of the Functional Ingredients, a stable composition was formed.

A method of preparation that we have found generally suitable for preparing stable mixtures from those Formulations which are capable of providing them, is to mix the Active Ingredients or their hydrates, in a concentrated form, with concentrated (e.g. 30 to 60%, preferably 45–50%) aqueous silicate solution, or alternatively, a concentrated solution of any other non-surfactant electrolyte required in the Formulation. Other ingredients are then added including any anti-redeposition agents, optical brightening agents and foaming agents. The Builder, when not required to provide the initial Electrolyte solution, may be added last. During mixing, just sufficient water is added at each addition to maintain the composition fluid and homogeneous. When all the Functional Ingredients are present, the mixture is diluted to provide the required Pay Load. Typically, mixing is carried out at ambient temperature where consistent with adequate dispersion, certain ingredients, e.g. non-ionic surfactants such as coconut monoethanolamide require gentle warming e.g. 40° for adequate dispersion. This degree of warming may generally be achieved by the heat of hydration of sodium tripolyphosphate. To ensure sufficient warming we prefer to add the tripolyphosphate in the anhydrous form containing a sufficiently high proportion of the high temperature rise modification commonly called "Phase I". The foregoing procedure is only one of several methods that may be satisfactorily used for all or most of the compositions of our invention. Some formulations are more sensitive to the order and temperature of mixing than others.

FORMULATION TYPES

Typically, our Formulations may most conveniently be one of the following types; (A) A non soap anionic type in which the Active Ingredient preferably consists at least predominantly of sulphated or sulphonated anionic surfactant, optionally with a minor proportion of non-ionic surfactant; (B) A Soap based detergent wherein the Active Ingredient consists of or comprises a substantial proportion of Soap, preferably a major proportion, together optionally with non-ionic, and/or sulphated or sulphonated anionic surfactant; (C) A Non-ionic type in which the Active Ingredient consists, at least predominantly of non-ionic surfactant, optionally with minor proportions of anionic surfactant, soap, cationic fabric softener and/or amphoteric surfactant.

The foregoing typs are not an exhaustive list of Formulation types of our invention which includes other types not listed separately above.

Considering the different types of Formulation according to our invention in more detail, we particularly distinguish, among type "A", high foaming sulphate or sulphonate type formulations and low foaming type "A" formulations.

High foaming type "A" Formulations may typically be based on sodium C10–14 straight or branched chain alkyl benzene sulphonate, alone or in admixture with a C10–18 alkyl sulphate and/or C10–20 alkyl 1–10 mole ether sulphate. Small amounts (e.g. up to 1% of the weight of the compositions) of Soap may be present to aid rinsing of the fabric. Nonionic foam boosters and stabilisers, such as $C_{12-18}$ acyl (e.g. coconut) monoethanolamide or diethanolamide or their ethoxylates, ethoxylated alkyl phenol, fatty alcohols or their ethoxylates may optionally be present as a foam booster or stabilisers, usually in proportions up to about 6% of the Dry Weight of the composition.

The sodium alkyl benzene sulphonate may be totally or partially replaced, in the above Formulations by other sulphonated surfactants including fatty alkyl xylene or toluene sulphonates, or by e.g. alkyl ether sulphates (preferably) or alkyl sulphates, paraffin sulphonates and olefin sulphonates, sulphocarboxylates, and their esters and amides, including sulphosuccinates and sulphosuccinamates, alkyl phenyl ether sulphates, fatty acyl monoethanolamide ether sulphates or mixtures thereof.

According to a specific embodiment, therefore, our invention provides a Non-sedimenting, Pourable, detergent composition comprising: water; from 15 to 60% Dry Weight of surfactant based on the Dry Weight of the composition at least partly present as a lamellar Separable Phase; and from 20 to 80% Dry Weight of Builder based on the Dry Weight of the composition at least partly present as suspended solid; and wherein said surfactant consists predominantly of anionic sulphated or sulphonated surfactant, together optionally with minor proportions, up to 20% by Dry Weight of the composition of nonionic foaming agent and/or foam stabiliser, and up to 6% by Dry Weight of the composition of Soap.

Preferably the sulphated or sulphonated anionic surfactant consists substantially of alkyl benzene sulphonate preferably sodium alkyl benzene sulphonate, e.g. C10–14 alkyl benzene sulphonate. The proportion of alkyl benzene sulphonate in the absence of foam boosters is preferably from 20 to 60% e.g. 30 to 55 of the Dry Weight of the composition.

Alternatively, the anionic surfactant may comprise a mixture of alkyl benzene sulphonate, and alkyl sulphate and/or alkyl ether sulphate and/or alkyl phenol ether sulphate in weight proportions of e.g. from 1:5 to 5:1 typicaly 1:2 to 2:1 preferably 1:1.5 to 1.5:1 e.g. 1:1. In the latter case the total anionic surfactant is preferably from 15 to 50% e.g. 20 to 40% of the Dry Weight of the compositions, in the absence of foam booster.

The alkyl sulphate, and/or alkyl ether sulphate for use in admixture with the alkyl benzene sulphonate typically has an average of from 0 to 5 ethyleneoxy groups per sulphate group e.g. 1 to 2 groups.

In an alternative type "A" Formulation the anionic surfactant consists substantially of alkyl sulphate and/or, alkyl ether sulphate. The total concentration of Active Ingredients in the absence of foam booster is preferably from 15 to 50% of the Dry Weight of the composition. Typically the Active Ingredients comprise an average of from 0 to 5 e.g. 0.5 to 3 ethyleneoxy groups per molecule of sulphated surfactant. The fatty alkyl chain length is preferably from 10 to 20C, higher chain lengths being preferred with higher ethylene-oxy content.

The foregoing types may be varied by substituting for all or part of the anionic active agent, any of the sulphated or sulphonated anionic surfactant classes hereinbefore specified.

Soap may be added to any of the foregoing detergent Formulations as an aid to rinsing the fabric. Soap is preferably present for this purpose in concentrations of from 0 to 6% preferably 0.1 to 4% e.g. 0.5 to 2% by Dry Weight of the composition. The amount of Soap is preferably less than 25% of the total sulphated and sulphonated surfactant, to avoid foam suppression: typically less than 10%.

Foam boosters and/or stabilisers may be incorporated in any of the foregoing types of high foam anionic detergent. The foam boosters or stabilisers are typically $C_{10-18}$ alkyl nonionic surfactants such as coconut monoethanolamide or diethanolamide or their ethoxylates, alkyl phenol ethoxylates, fatty alcohols or their ethoxylates or fatty acid ethoxylates. The foam booster and/or stabiliser is added typically in proportions up to 20% of the Dry Weight of the composition e.g. 0.1 to 6% preferably 0.5 to 4%. The presence of foam booster and/or stabiliser may permit a reduction of total concentration of Active Ingredients in a high foam product. Typically, compositions comprising alkyl benzene sulphonate with a foam booster and/or stabiliser will contain from 15 to 40% of alkyl benzene sulphate based on the weight of the composition preferably 20 to 36% e.g. 25% with from 2 to 6% e.g. 4% of nonionic surfactant, the lower proportions of anionic surfactant being preferred with higher proportions of nonionic surfactant and vice versa. The other sulphated or sulphonated anionic surfactant Formulations discussed above may be similarly reduced in active concentration by inclusion of foam boosters and/or stabilisers.

The Builder is preferably sodium tripolyphosphate, optionally but preferably with a minor proportion of soluble silicate although the alternative Builders hereinbefore described may be employed instead, as may mixed Builders. The proportion of Builder in type "A" formulations is usually at least 30% of the Dry Weight of the composition, preferably from 35% to 85% e.g. 40 to 80%. Builder proportions in the range 50 to 70% of Dry Weight are particularly preferred. The Builder to Active Ingredients ratio should desirably be greater than 1:1 preferably from 1.2:1 to 4:1 e.g. from 1.5:1 to 3:1.

Low foaming type "A" Formulations are generally dependent upon the presence of lower proportions of sulphated or sulphonated anionic surfactant than in the high foam types together with higher, but still minor, proportions of Soap, and/or the addition of non-ionic, silicone, or phosphate ester foam depressants.

Our invention therefore provides, according to a second specific embodiment, a Non-sedimenting Pourable fluid, aqueous based detergent composition, comprising an at least predominantly aqueous phase containing Electrolyte in solution, and suspended particles of Builder, said composition comprising from 15 to 50% based on Dry Weight of Active Ingredient, at least 30% of Builder based on Dry Weight, a ratio of Builder to Active Ingredient greater than 1:1, and optionally the Usual Minor Ingredients, wherein the surfactant comprises from 15 to 50% based on the Dry weight of the composition of sulphated and/or sulphonated anionic surfactant and an effective amount of at least one foam depressant.

Preferably, the foam depressant is selected from Soap, in a proportion of from 20 to 60% based on the weight of sulphated or sulphonated anionic surfactant, $C_{16-20}$ alkyl nonionic foam depressant in a proportion of up to 10% of the Dry Weight of the composition, $C_{16-20}$ alkyl phosphate ester in a proportion of up to 10% of the Dry Weight of the composition and silicone antifoams.

The function of Soap as a foam depressant is dependent on the proportion of Soap to sulphated or sulphonated anionic surfactant. Proportions of 10% or less are not effective as foam depressants but are useful as rinse aids in high foaming detergent compositions. Foam depressant action requires a minimum proportion of about 20% of soap based on the sulphated and/or sulphonated surfactant. If the proportion of soap to sulphated/sulphonated surfactant in a type "A" detergent is above about 60% by weight, the foam depressant action is reduced. Preferably, the proportion of Soap is from 25 to 50% e.g. 30 to 45% of the weight of sulphated/sulphonated surfactant.

Low foaming type "A" surfactants may contain, in addition to, or instead of soap, a nonionic foam depressant. This may, for example, be a $C_{16-22}$ acyl monoethanolamide e.g. rape monoethanolamide, a $C_{16-22}$ alkyl phenol ethoxylate, $C_{16-22}$ alcohol ethoxylate or $C_{16-22}$ fatty acid ethoxylate. Alternatively, or additionally, the composition may contain an alkali metal mono and/or di $C_{16-22}$ alkyl phosphate ester. The nonionic or phosphate ester foam depressant is typically present in the Formulation in a proportion of up to 10%, preferably 2 to 8% e.g. 3 to 4% based on Dry Weight.

Silicone antifoams may also be used, as or as part of, the foam depressant. The effective concentration of these last in the formulation is generally substantially lower than in the case of the other foam depressants discussed above. Typically, it is less than 2%, preferably less than 0.1%, usually 0.01 to 0.05% e.g. 0.02% of the Dry Weight of the formulation.

Type "A" formulations preferably contain the Usual Minor Ingredients. Certain fabric softeners, such as clays, may be included, however cationic fabric softeners are not normally effective in anionic based Formulations, but may sometimes be included in specially formulated systems.

The type "B" Formulations of our invention comprise Soap as the principal active component. They may additionally contain minor amounts of nonionic or other anionic surfactants.

The typical percentage Dry Weight of type "B" Formulations may be rather lower than type "A", e.g. 25 to 60%, preferably 29 to 45%. The total proportion of Active Ingredients is usually between 10 and 60%, preferably 15 to 40% e.g. 20 to 30% of the Dry Weight of the composition. Builder proportions are typically 30 to 80% of Dry Weight. In general the mobility of type "B" Formulation can be improved by including sufficient water soluble inorganic electrolyte, especially sodium silicate, in the Formulation.

High foam Soap Formulations may typically contain Active Ingredient consisting substantially of Soap, optionally with a minor proportion of a nonionic foam booster and/or stabilizer as described in relation to type "A" Formulations, and/or with sulphated anionic booster such alkyl ether sulphate or alkyl ether sulphosuccinate.

Low foam type B Formulations may contain a lower concentration of Soap together with minor proportions of sulphated and or sulphonated anionic surfactant, nonionic or phosphate ester foam depressants and/or silicone antifoams.

The relationship between sulphated and/or sulphonated anionic surfactants and Soap in a type "B" low foam formulation is the converse of that in a type "A" low foam formulation. In a type "B" formulation, the sulphated and/or sulphonated anionic surfactant acts as foam suppressant when present in a proportion of from about 20 to about 60% of the weight of the Soap.

The nonionic, phosphate ester and silicone foam depressant are, conveniently, substantially as described in relation to type "A" detergents.

"Type "B" detergents may contain any of the Usual Minor Ingredients. As in the case of type A Formulations, cationic fabric softners are not normally included, but other fabric softeners may be present.

Nonionic based detergents of type "C" represent a particularly important aspect of the present invention. There has been a trend towards the use of non-ionic surfactants in laundry detergents because of the increasing proportion of man-made fibre in the average wash. Non-ionics are particularly suitable for cleaning man-made fibres. However, no commercially acceptable, fully built, non-ionic liquid detergent formulation has yet been marketed.

Even in the detergent powder field, the choice and level of non-ionic surfactant has been restricted. Many of the detergent Formulations of our invention hereinbefore described have been designed to give stable, Pourable, fluid detergent compositions having a washing performance equivalent to existing types of powder Formulation, or to compositions which could readily be formulated as powders. However, it has not hitherto been possible to formulate certain types of potentially desirable nonionic based detergents satisfactorily, even as powders. This is because "solid" compositions containing sufficiently high proportions of the desired nonionic surfactant often form sticky powders which do not flow freely and may give rise to packaging and storage problems. Such surfactants have therefore had to be restricted to below optimum proportions of detergent powders, or to low Pay Load, dilute, or light duty, liquid formulations.

Our invention therefore provides, according to a preferred specific embodiment, a Non-sedimenting, Pourable, fluid, aqueous based, detergent composition comprising at least one predominantly liquid aqueous phase, at least one other phase containing surfactant and a solid Builder, said composition comprising from 10% to 50%, based on the Dry Weight thereof, of Active Ingredients and from 30% to 80%, based on the Dry Weight thereof, of Builder, wherein said Active Ingredients comprise at least a major proportion based on the weight thereof of nonionic surfactants having a HLB of from 10 to 18.

Preferably the surfactant is present as a Separable hydrated solid or liquid crystal Phase.

Any of the nonionic surfactants hereinbefore described or any mixture thereof may be used according to this embodiment of the invention. Preferably, the surfactant comprises a $C_{12-18}$ alkyl group, usually straight chain, although branched chain and/or unsaturated hydrocarbon groups are not excluded. Preferably, the nonionic surfactants present have an average HLB of 12 to 15.

The preferred nonionic surfactant in Type C Formulations is fatty alcohol ethoxylate.

For high foam type "C" Formulations, we prefer $C_{12-16}$ alkyl nonionics having 8 to 20 ethylenoxy groups, alkyl phenol ethoxylate having 6–12 aliphatic carbon atoms and 8 to 20 ethyleneoxy groups together optionally with a minor proportion e.g. 0 to 20% of the Dry Weight of the composition of anionic surfactant preferably sulphated and/or sulphonated anionic e.g. alkyl benzene sulphonate, alkyl sulphate, alkyl ether sulphate, paraffin sulphonate, olefin sulphonate or any of the other sulphated or sulphonated surfactants described above, but not including substantial amounts of any foam depressant. The Formulation may however include a nonionic foam booster and/or stabiliser such as $C_{10-18}$ acyl monoethanolamide typically in proportions as described above in relation to type "A" Formulations. Preferably the non-ionic Active Ingredients together have an HLB of 12–15.

Low foam nonionic compositions according to our invention are especially preferred. They preferably comprise 10 to 40% based on Dry Weight of the composition of $C_{12-18}$ alkyl 5 to 20 mole ethyleneoxy, nonionic surfactants such as fatty alcohol ethoxylates, fatty acid ethoxylates or alkyl phenol ethoxylates, having a preferred HLB of 12 to 15. They optionally contain a minor proportion, e.g. up to 10% by weight of the composition of any of the anionic sulphated and/or sulphonated surfactants hereinbefore described in relation to type "A" detergents, and they contain a foam depressant such as a mono, di- or trialkyl phosphate ester or silicone foam depressant, as discussed hereinbefore in the context of low foaming type "A" detergents.

Type "C" Formulations may contain any of the Usual Minor Ingredients.

In particular, nonionic based detergents of our invention may incorporate cationic fabric softeners. The cationic fabric softeners may be added to type "C" Formulations, in a weight proportion based on the nonionic surfactant of from 1:1.5 to 1:4 preferably 1:2 to 1:3. The cationic fabric softeners are cationic surfactants having two long chain alkyl or alkenyl groups, typically two $C_{16-20}$ alkyl or alkenyl groups, preferably two tallowyl groups. Examples include di $C_{12-20}$ alkyl di(lower, e.g. $C_{1-3}$, alkyl) ammonium salts, e.g. di tallowyl dimethyl ammonium chloride, di($C_{16-20}$ alkyl) benzalkonium salts e.g. ditallowyl methyl benzyl ammonium chloride, di $C_{16-20}$ alkyl amido imidazolines and di $C_{16-20}$ acyl amido amines or quaternised amino amines, e.g. bis(tallow amido ethyl) ammonium salts.

Formulations containing cationic fabric softeners preferably do not contain sulphated or sulphonated anionic surfactants or soaps. They may however contain minor proportions of anionic phosphate ester surfactants e.g. up to 3% by weight of the composition preferably up to 2%. They may additionally or alternatively contain minor proportions (e.g. up to 3%, preferably 1 to 2% by weight of amphoteric surfactants such as betaines and sulphobetaines. They may also contain smectite clays, and the Usual Minor Ingredients.

Minor Ingredients

Compositions of the invention may contain the Usual Minor Ingredients. Principal of these are antiredeposition agents, optical brightening agents and bleaches.

The most commonly used antiredeposition agent in making detergents is sodium carboxymethyl cellulose (SCMC), and we prefer that this be present in compositions of this invention e.g. in conventional amounts e.g. greater than 0.1 but less than 5%, and more usually between 0.2 and 4%, especially 0.5 to 2% preferably 0.7 to 1.5%. Generally speaking SCMC is effective at concentrations of about 1% and we prefer not to exceed the normal effective concentrations very substantially, since SCMC in greater amounts can raise the viscosity of a liquid composition very considerably. At the higher limits discussed above e.g. 4–5% of SCMC, many Formulations cannot be obtained in a Pourable form at high Payloads.

Alternative antiredeposition and/or soil releasing agents include methylcellulose, polyvinylpyrrolidone, carboxymethyl starch and similar poly electrolytes, all of which may be used in place of SCMC, as may other water soluble salts of carboxymethyl cellulose.

Optical Brighteners (OBA's) are optional, but preferred, ingredients of the compositions of our invention. Unlike some prior art formulations, our compositions are not dependent on OBA's for stability and we are therefore free to select any convenient and cost effective OBA, or to omit them altogether. We have found that any of the fluorescent dyes hitherto recommended for use as OBA's in liquid detergents may be employed, as may many dyes normally suitable for use in powder detergents. The OBA may be present in conventional amounts. However we have found that OBA's in some liquid detergents (e.g. type C formulations) tend to be slightly less efficient than in powder detergents and therefore may prefer to add them in slightly higher concentrations relative to the Formulation than is normal with powders. Typically concentrations of OBA between 0.05 and 0.5% are sufficient e.g. 0.075 to 0.3% typically 0.1 to 0.2%. Lower concentrations could be used but are unlikely to be effective, while higher concentrations, while we do not exclude them, are unlikely to prove cost effective and may, in some instances give rise to problems of compatability.

Typical examples of OBA's which may be used in the present invention include: ethoxylated 1,2-(benzimidazolyl)ethylene; 2-styrylnaphth[1,2d-]oxazole; 1,2-bis(5' methyl-2-benzoxazolyl)ethylene; disodium-4,4'-bis(6-methylethanolamine-3-anilino-1,3,5-triazin-2''-yl)-2,2'-stilbene sulphonate; N-(2-hydroxyethyl-4,4'-bis(-benzimidazolyl)stilbene; tetrasodium 4,4'-bis[4''-bis(2''-hydroxyethyl)-amino-6''(3''-sulphophenyl)amino-1'',3'',5''-triazin-2''-yl amino]-2,2'-stilbenedisulphonate; disodium-4-(6''-sulphonaphtho[1',2'-d]triazol-2-yl)-2-stilbenesulphonate; disodium 4,4'-bis[4''-(2'''-hydroxyethoxy)-6''-amino-1'',3'',5''-triazin-2''-yl amino]-2,2'-stilbenedisulphonate; 4-methyl-7-dimethyl aminocoumarin; and alkoxylated 4,4-bis-(benzimidazolyl) stilbene.

Bleaches may optionally be incorporated in liquid detergent compositions of our invention subject to chemical stability and compatibility. Encapsulated bleaches may form part of the suspended solid.

The action of peroxy bleaches in compositions of our invention may be enhanced by the presence of bleach activators such as tetra acetyl ethylenediamine, in effective amounts.

Photoactive bleaches such as zinc or aluminium sulphonated phthalocyanin, may be present.

Perfumes and colourings are conventionally present in laundry detergents in amounts up to 1 or 2%, and may similarly be present in compositions of our invention. Provided normal care is used in selecting additives which are compatible with the Formulation, they do not affect the performance of the present invention.

Proteolytic and amylolitic enzymes may optionally be present in conventional amounts, together optionally with enzyme stabilizers and carriers. Encapsulated enzymes may be suspended.

Other Minor Ingredients include germicides such as formaldehyde, opacifiers such as vinyl latex emulsion and anticorrosives such as benzotriazole.

Compositions of our invention are, in general, suitable for laundry use and our invention provides a method of washing clothes by agitating them in a wash liquor containing any composition of the invention as described herein. Low foam compositions herein described are in particular of use in automatic washing machines. The compositions may also be used in the washing of dishes, or the cleaning of hard surfaces, the low foam products being particularly suitable for use in dishwashing machines. These uses constitute a further aspect of the invention.

Compositions of our invention may, generally, be used for washing clothes in boiling water, or for washing at medium or cool temperatures, e.g. 50° to 80° C., especially 55° to 68° C., or 20 to 50° C. especially 30° to 40° C., respectively. Typically the compositions may be added to the washwater at concentrations of between 0.05 and 3% Dry Weight based on the wash water preferably 0.1 to 2%, more usually 0.3 to 1% e.g. 0.4 to 0.8%.

The invention will be illustrated by the following examples: wherein all figures relate to % by wt. based on total composition, unless otherwise stated.

COMPOSITIONS OF THE VARIOUS FEEDSTOCKS MATERIALS

1. Sodium $C_{10-14}$ linear alkyl benzene sulphonate

For all formulations the alkyl benzene sulphonate used was the sodium salt of the largely para-sulphonated "Dobane" JN material. (Dobane is a Registered Trade Mark).

The composition is as follows:

| $C_{10}$ | $C_{11}$ | $C_{12}$ | $C_{13}$ | $C_{14}$ | $C_{15}$ |
|---|---|---|---|---|---|
| 13.0 | 27.0 | 27.0 | 19.0 | 11.0 | 1.0 |

This composition refers only to the alkyl chain length.

2. Coconut Monoethanolamide

Has the following composition:

$RCO(NHCH_2CH_2OH)$ where R is as follows:

| | | |
|---|---|---|
| | $C_5$ | 0.5% |
| | $C_7$ | 6.5% |
| | $C_9$ | 6.0% |
| | $C_{11}$ | 49.5% |
| | $C_{13}$ | 19.5% |
| | $C_{15}$ | 8.5% |
| Stearic | $C_{17}$ | 2.0% |
| Oleic | $C_{17}$ | 6.0% |
| Linoleic | $C_{17}$ | 1.5% |

3. Sodium alpha olefin sulphonate

This material is the sodium salt of sulphonated $C_{16}/C_{18}$ olefin having the following approximate composition.

| | | |
|---|---|---|
| 55.0% | $C_{16}$ | Terminal olefin |
| 45.0% | $C_{18}$ | Terminal olefin |

4. $C_{12}$–$C_{18}$ Alcohol + 8 moles Ethylene Oxide

This material is an average 8 mole ethylene oxide condensate of an alcohol of the following composition:

| | |
|---|---|
| $C_{10}$ | 3.0% |
| $C_{12}$ | 57.0% |
| $C_{14}$ | 20.0% |
| $C_{16}$ | 9.0% |
| $C_{18}$ | 11.0% |

5. Sodium $C_{14-17}$ n-Alkane Sulphonate

This material was prepared by neutralising sulphonated $C_{14}$–$C_{17}$ normal paraffins with sodium hydroxide and contained 10% disulphonates based on total Active Ingredients.

6. Sodium $C_{12}$–$C_{18}$ Sulphate

This refers to the sodium salt of a sulphated fatty alcohol having the following composition:

| | |
|---|---|
| $C_{10}$ | 3.0% |
| $C_{12}$ | 57.0% |
| $C_{14}$ | 20.0% |
| $C_{16}$ | 9.0% |
| $C_{18}$ | 11.0% |

7. Sodium Tripolyphosphate

This material was added as anhydrous $Na_5P_3O_{10}$ containing 30% Phase I.

8. Sodium Silicate

This material is added to Formulations as a viscous aqueous solution containing 47% solids with a $Na_2O$:-$SiO_2$ ratio of 1:1.6.

9. Optical Brightener

The optical brightening agent for Examples 51 to 66 was the disodium salt of 4;4'-[di(styryl-2-sulphonic acid)]biphenyl which is marketed under the trademark "TINOPAL CBS-X". The optical brightener for Examples 1 to 50 was a mixture of the aforesaid Optical brightener with the disodium salt of 4;4'-[di(4-chlorostyryl-3-sulphonic acid)]biphenyl which mixture is marketed under the trademark "TINOPAL ATS-X".

Note

All alcohols and their ethylene oxide adducts referred to are straight chained and primary.

All the examples were prepared by adding the surfactant, usually as hydrated solid, to a 47% solution of the silicate. The other ingredients were then added in the order shown in the tables reading from top to bottom, except that the principal Builder was added last. At each stage, a small addition of water was made, whenever it was required in order to maintain a fluid homogeneous system. Finally, the composition was diluted to the desired percentage Dry Weight. The entire preparation was carried out as close as possible to ambient temperature consistent with adequate dispersion of the ingredients. In the case of examples 20, 21, 22 and 23, a concentrated aqueous solution of the electrolyte (i.e. sodium sulphate, sodium chloride, sodium carbonate and potassium carbonate respectively) was used in place of the solution of silicate in the above procedure. In some instances, especially with relatively high melting non-ionic surfactants, such as coconut monoethanolamide, gentle warming e.g. to about 40° C. was required to ensure complete dispersion. In all the Examples in which sodium tripolyphosphate was used in substantial amounts this temperature was achieved by the heat of hydration without external heating.

| Components | Eg. 1 | Eg. 2 | Eg. 3 | Eg. 4 | Eg. 5 (a) | Eg. 5 (b) | Eg. 5 (c) | Eg. 6 | Eg. 7 | Eg. 8 | Eg. 9 (a) | Eg. 9 (b) | Eg. 10 (a) | Eg. 10 (b) | Eg. 11 | Eg. 12 | Eg. 13 | Eg. 14 |
|---|---|---|---|---|---|---|---|---|---|---|---|---|---|---|---|---|---|---|
| Sodium $C_{10-14}$ linear alkylbenzene sulphonate | 12.4 | 15.9 | 12.2 | 15.6 | 11.2 | 12.0 | 13.0 | 14.0 | 12.0 | 12.0 | 11.6 | 12.6 | 17.0 | 18.0 | 11.6 | 9.9 | | |
| Coconut monoethanolamide | 1.6 | 2.1 | 1.6 | 2.1 | 1.5 | 1.6 | 1.7 | 1.9 | 1.6 | 1.6 | 1.5 | 1.7 | 1.5 | 1.5 | 1.5 | 1.3 | 1.2 | 1.3 |
| Sodium tripolyphosphate | 26.0 | 19.1 | 25.6 | 18.7 | 26.2 | 28.0 | 30.4 | 32.7 | 28.0 | 28.0 | 30.2 | 32.7 | 25.5 | 27.0 | 25.7 | 23.1 | 21.0 | 23.4 |
| Sodium Silicate | 6.5 | 8.5 | 6.4 | 9.3 | 6.0 | 6.4 | 7.0 | 7.5 | 6.4 | 6.4 | 6.2 | 6.7 | 5.8 | 6.2 | 3.5 | 5.3 | 4.8 | 5.4 |
| Sodium carboxymethyl cellulose | — | — | 1.4 | 1.8 | 1.5 | 1.6 | 1.7 | — | 1.6 | 1.6 | 1.5 | 1.7 | 1.5 | 1.5 | 1.5 | 2.0 | 1.2 | 1.3 |
| Optical Brightening Agent | — | — | 0.2 | 0.2 | 0.15 | 0.16 | 0.17 | 0.18 | — | 0.16 | 0.15 | 0.17 | 0.16 | 0.17 | 0.13 | 0.14 | 0.11 | 0.12 |
| Benzotriazole | — | — | — | — | — | — | — | — | — | 0.007 | | | | | | | | |
| Perfume | — | — | — | — | — | — | — | — | — | 0.05 | | | | | | | | |
| Water | to 100 | to 100 | to 100 | to 100 | to 100 | to 100 | to 100 | to 100 | to 100 | to 100 | to 100 | to 100 | to 100 | to 100 | to 100 | to 100 | to 100 | to 100 |
| Triethanolamine C16–C18 alkyl sulphate | | | | | | | | | | | | | | | | | 9.0 | — |
| Sodium C16–18 alkyl sulphate | | | | | | | | | | | | | | | | | — | 10.0 |
| Sodium salt of alpha sulpho C16–18 fatty acid methyl ester | | | | | | | | | | | | | | | | | — | — |
| Sodium salt of three mole ethoxylate of C16–18 alcohol sulphate | | | | | | | | | | | | | | | | | — | — |
| Disodium C16–18 alkyl sulphosuccinamate | | | | | | | | | | | | | | | | | — | — |
| Sodium salt of two mole ethoxylate of C12–14 alcohol sulphate | | | | | | | | | | | | | | | | | — | — |
| Sodium C9–13 linear alkylbenzene sulphate | | | | | | | | | | | | | | | | | — | — |

| Components | Eg. 15 | Eg. 16 | Eg. 17 | Eg. 18 | Eg. 19 | Eg. 20 | Eg. 21 | Eg. 22 | Eg. 23 | Eg. 24 (a) | Eg. 24 (b) | Eg. 24 (c) | Eg. 25 | Eg. 26 | Eg. 27 | Eg. 28 | Eg. 29 | Eg. 30 |
|---|---|---|---|---|---|---|---|---|---|---|---|---|---|---|---|---|---|---|
| Triethanolamine C16–C18 alkyl sulphate | — | — | — | — | — | | | | | | | | | | | | | |
| Sodium C16–18 alkyl sulphate | — | — | — | — | — | | | | | | | | | | | | | |
| Sodium salt of alpha sulpho C16–18 fatty acid methyl ester | 8.5 | — | — | — | — | | | | | | | | | | | | | |
| Sodium salt of three mole ethoxylate of C16–18 alcohol sulphate | — | 9.6 | — | — | — | | | | | | | | | | | | | |
| Disodium C16–18 alkyl sulphosuccinamate | — | — | 10.8 | — | — | | | | | | | | | | | | | |
| Sodium salt of two mole ethoxylate of C12–14 alcohol sulphate | — | — | — | 10.8 | — | | | | | | | | | | | | | |
| Sodium C9–C13 linear alkylbenzene sulphate | — | — | — | — | 12.0 | | | | | | | | | | | | | |
| Coconut monoethanolamide | 1.1 | .13 | 1.4 | 1.5 | 1.6 | 1.6 | 1.6 | 1.6 | 1.6 | — | — | — | 1.7 | 1.5 | 1.3 | 2.2 | 1.9 | 1.8 |
| Sodium tripolyphosphate | 19.8 | 22.5 | 25.3 | 25.3 | 28.1 | 28.2 | 28.2 | 28.2 | 28.2 | 16.7 | 18.9 | 20.0 | 29.1 | — | 15.8 | — | 14.0 | — |
| Sodium silicate | 4.5 | 5.1 | 5.8 | 5.9 | 6.5 | — | — | — | — | 3.3 | 3.8 | 4.0 | — | 6.0 | 5.5 | 8.8 | 8.0 | 7.1 |
| Sodium carboxymethyl cellulose | 1.1 | 1.3 | 1.4 | 1.5 | 1.6 | 1.6 | 1.6 | 1.6 | 1.6 | 1.3 | 1.5 | 1.6 | 1.7 | 1.5 | 1.3 | 2.2 | 1.9 | 1.8 |
| Optical brightening agent | 0.10 | 0.13 | 0.14 | 0.14 | 0.15 | 0.15 | 0.15 | 0.15 | 0.15 | 0.17 | 0.19 | 0.20 | 0.15 | 0.14 | 0.13 | 0.2 | 0.19 | 0.17 |
| Water | to 100 | to 100 | to 100 | to 100 | to 100 | to 100 | to 100 | to 100 | to 100 | to 100 | to 100 | to 100 | to 100 | to 100 | to 100 | to 100 | to 100 | to 100 |
| Sodium C10–14 linear alkylbenzene sulphonate | | | | | | 12.1 | 12.1 | 12.1 | 12.1 | 15.0 | 17.0 | 18.0 | 12.5 | | | | | |
| Sodium sulphate | | | | | | 7.5 | — | — | — | — | — | — | — | | | | | |
| Sodium chloride | | | | | | — | 6.2 | — | — | — | — | — | — | | | | | |
| Sodium carbonate | | | | | | — | — | 5.6 | — | 4.2 | 4.7 | 5.0 | — | | | | | |
| Potassium carbonate | | | | | | — | — | — | 7.3 | — | — | — | — | | | | | |
| Sodium C10–14 linear alkylbenzene sulphonate | | | | | | | | | | | | | | 11.2 | 10.2 | 16.1 | 15.0 | 13.3 |
| Zeolite A | | | | | | | | | | | | | | 34.8 | 15.8 | — | — | — |
| Trisodium Citrate | | | | | | | | | | | | | | — | — | — | — | 31.0 |
| Trisodium nitrilo triacetate | | | | | | | | | | | | | | — | — | 30.6 | 14.0 | — |
| Sodium Orthophosphate | | | | | | | | | | | | | | — | — | — | — | — |

| | Eg. 43 |
|---|---|

-continued

| Components | Eg. 31 | Eg. 32 | Eg. 33 | Eg. 34 | Eg. 35 | Eg. 36 | Eg. 37 | Eg. 38 | Eg. 39 | Eg. 40 | Eg. 41 | Eg. 42 | (a) | (b) | (c) | Eg. 44 | Eg. 45 | Eg. 46 |
|---|---|---|---|---|---|---|---|---|---|---|---|---|---|---|---|---|---|---|
| Sodium C10-14 linear alkylbenzene sulphonate | 10.2 | 14.2 | 12.0 | 13.1 | | | | | | | | | 1.2 | 1.3 | 1.5 | 1.6 | 1.8 | 2.1 |
| Coconut monoethanolamide | 1.4 | 1.9 | 1.6 | 1.7 | 1.1 | 1.5 | 1.7 | 1.7 | 1.6 | 1.5 | 1.7 | 1.7 | | | | | | |
| Zeolite A | — | — | | | | | | | | | | | | | | | | |
| Trisodium Citrate | — | — | | | | | | | | | | | | | | | | |
| Trisodium nitrilo triacetate | — | — | | | | | | | | | | | | | | | | |
| Sodium Tripolyphosphate | 15.8 | 33.1 | 28.0 | 30.7 | 18.5 | 25.7 | 30.1 | 29.1 | 28.1 | 25.9 | 29.1 | 30.8 | 13.9 | 15.0 | 17.4 | 20.0 | 22.6 | 24.8 |
| Sodium Orthophosphate | 8.8 | — | | | | | | | | | | | | | | | | |
| Sodium silicate | 5.4 | 3.8 | 6.4 | 7.0 | 6.4 | 5.9 | 8.6 | 10.1 | 6.5 | 7.4 | 10.1 | 12.4 | 3.0 | 3.3 | 3.8 | 5.0 | 6.0 | 7.8 |
| Sodium carboxymethyl cellulose | 1.4 | 1.9 | 1.6 | 1.7 | 1.1 | 1.5 | 1.7 | 1.7 | 1.6 | 1.5 | 1.7 | 1.7 | 0.8 | 0.9 | 1.0 | 1.1 | 1.3 | 1.3 |
| Optical brightening agent | 0.13 | 0.18 | — | 0.18 | 0.10 | 0.14 | 0.17 | 0.16 | 0.16 | 0.14 | 0.16 | 0.16 | 0.11 | 0.12 | 0.13 | 0.14 | 0.16 | 0.18 |
| Water | to 100 | to 100 | to 100 | to 100 | to 100 | to 100 | to 100 | to 100 | to 100 | to 100 | to 100 | to 100 | to 100 | to 100 | to 100 | to 100 | to 100 | to 100 |
| Sodium xylene sulphonate | | | — | 5.5 | | | | | | | | | | | | | | |
| Detergent Enzymes (Esperase Slurry 8.0) | | | 0.07 | — | | | | | | | | | | | | | | |
| Triethanolamine C16-18 alkyl sulphate | | | | | 7.9 | — | — | — | — | — | — | — | | | | | | |
| Sodium C16-18 alpha olefin sulphonates | | | | | — | 11.0 | 12.8 | 12.4 | — | — | — | — | | | | | | |
| Sodium C14-17 n-alkane sulphonate | | | | | — | — | — | — | 12.0 | 11.1 | 12.4 | 13.2 | | | | | | |
| Sodium soap, based on fatty acid of 274 Mean Molar Weight | | | | | | | | | | | | | 3.7 | 4.0 | 4.6 | 5.2 | 5.9 | 6.4 |
| Eleven moles ethoxylate of C16-18 alcohol | | | | | | | | | | | | | 1.4 | 1.5 | 1.8 | 2.0 | 2.2 | 2.4 |

| Components | Eg. 47 | Eg. 48 (a) | Eg. 48 (b) | Eg. 48 (c) | Eg. 49 | Eg. 50 (a) | Eg. 50 (b) | Eg. 50 (c) | Eg. 51 | Eg. 52 | Eg. 53 | Ex. 54 | Eg. 55 | Eg. 56 | Eg. 57 | Eg. 58 | Eg. 59 | Eg. 60 |
|---|---|---|---|---|---|---|---|---|---|---|---|---|---|---|---|---|---|---|
| Sodium C10-14 linear alkylbenzene sulphonate | 1.3 | 8.5 | 9.0 | 10.0 | 3.6 | — | — | — | — | 4.1 | — | — | — | — | 11.4 | 11.8 | 12.0 | 10.9 |
| Sodium soap, based on a fatty acid of 274 Mean Molar Weight | 6.6 | | | | | | | | | | | | | | | | | |
| Eleven moles ethoxylate of C16-C18 alcohol | 2.1 | | | | | | | | | | | | | | | | | |
| Sodium tripolyphosphate | 19.8 | 25.5 | 27.0 | 29.0 | 24.9 | 21.4 | 24.5 | 27.5 | 30.6 | 24.6 | 22.4 | 21.8 | 21.7 | 26.7 | 26.7 | 27.6 | 28.0 | 25.5 |
| Sodium silicate | 3.8 | 5.1 | 5.4 | 6.0 | 3.6 | 4.9 | 5.6 | 6.3 | 7.0 | 6.0 | 5.5 | 5.3 | 5.0 | 6.2 | 6.2 | 6.4 | 6.4 | 5.8 |
| Sodium carboxymethyl cellulose | 1.2 | 1.4 | 1.4 | 1.6 | 0.7 | 1.0 | 1.1 | 1.3 | 1.4 | 1.2 | 1.1 | 1.0 | 0.9 | 1.5 | 1.5 | 1.6 | 1.6 | 1.4 |
| Optical brightening agent | 0.10 | 0.17 | 0.18 | 0.20 | 0.14 | 0.11 | 0.12 | 0.14 | 0.15 | 0.13 | 0.12 | 0.11 | — | 0.15 | 0.15 | 0.15 | 0.15 | 0.13 |
| Water | to 100 | to 100 | to 100 | to 100 | to 100 | to 100 | to 100 | to 100 | to 100 | to 100 | to 100 | to 100 | to 100 | to 100 | to 100 | to 100 | to 100 | to 100 |
| Fifteen moles ethoxylate of C16-C18 alcohol | | — | — | — | 7.1 | — | — | — | — | — | — | — | 4.6 | | | | | |
| Sodium salt of a 50:50 mixed mono and di C16-18 alkyl phosphate | | 1.7 | 1.8 | 2.0 | — | — | — | — | — | 0.8 | 0.7 | 0.7 | 0.6 | | | | | |
| Silicone defoamer | | — | — | — | 0.02 | | | | | | | | | | | | | |
| Sodium salt of three mole ethoxylate of C12-15 alcohol sulphate | | | | | | — | — | — | — | — | 3.7 | — | — | | | | | |
| Coconut monoethanolamide | | | | | | 1.8 | 2.1 | 2.3 | 2.6 | — | — | — | — | 1.5 | — | — | 1.6 | 1.4 |
| Eight mole ethoxylate of C12-18 alcohol | | | | | | 5.8 | 6.6 | 7.5 | — | 8.2 | 7.5 | 10.8 | 4.6 | | | | | |
| 2-tallow-1-methyl-1-(tallow-amidoethyl) imidazoline methyl sulphate | | | | | | — | — | — | — | — | — | — | 2.5 | | | | | |
| Five mole ethoxylate of C13-C15 alcohol | | | | | | — | — | — | 8.3 | — | — | — | — | | | | | |
| Sodium $C_{12}$ branched chain Alkyl Benzene Sulphonate | | | | | | | | | | | | | | 11.4 | — | — | — | — |
| Coconut diethanolamide | | | | | | | | | | | | | | — | 1.5 | — | — | — |
| Sodium ethylenediamine tetrakis (methenephosphonate) | | | | | | | | | | | | | | — | — | — | 0.25 | 2.3 |

| Components | Eg. 61 | Eg. 62 | Eg. 63 | Eg. 64 | Eg. 65 | Eg. 66 |
|---|---|---|---|---|---|---|
| Sodium $C_{10-14}$ Linear alkylbenzene sulphonate | 5.2 | 6.5 | — | — | 11.5 | 10.9 |
| Sodium $C_{16-18}$ Alkyl Sulphate | 3.7 | 4.6 | — | — | 7.6 | 7.2 |

-continued

| | | | | | | |
|---|---|---|---|---|---|---|
| Sodium 1 mole ethoxy $C_{14-15}$ alkyl ether sulphate | 4.5 | 5.5 | | | | |
| $C_{12-18}$ alcohol 8 mole ethoxylate | 1.5 | 1.9 | 2.7 | 2.7 | 2.9 | 2.7 |
| Sodium Tripolyphosphate | — | 29.6 | 13.4 | — | 14.3 | — |
| Sodium Silicate | 18.6 | — | 8.9 | 8.9 | 9.6 | 9.0 |
| Sodium Carbonate | 14.9 | — | | | | |
| Sodium Carboxymethylcellulose | 1.5 | 1.8 | 1.4 | 1.4 | 1.5 | 1.5 |
| Optical Brightening Agent | 0.15 | 0.18 | 0.14 | 0.14 | 0.15 | 0.15 |
| Water | to 100 | to 100 | to 100 | to 100 | to 100 | to 100 |
| Sodium $C_{14-16}$ alpha olefin sulphonate | | | 17.9 | 17.9 | — | — |
| Zeolite A | | | — | 13.4 | — | 13.6 |

Of the Examples, 1 and 2 represent a basic type A Formulation, 3 and 4 a type A formulation with SCMC and optical brightener, 5(a), (b) and (c) represent a type A Formulation at three different Pay Loads, 6 and 7 demonstrate that neither SCMC nor optical brightener is essential to obtain a Non-sedimenting Formulation; 8 contains anticorrosive and perfume; 9 (a) and (b) illustrate a high Builder to Active ratio Formulation (3:1) at two Pay Loads, 10(a) and (b) illustrate a relatively low Builder to Active Formulation at two Pay Loads; 11 corresponds to a Non-sedimenting Formulation obtained by centrifuging the Formulation of Example 9 at low Payload for only three hours and decanting the supernatent liquor; 12 illustrates the effect of relatively high SCMC levels; 13 to 19 illustrate Type A Formulations with various anionic surfactants; 20 to 24 illustrate various Electrolytes, and 25 is a Formulation in which sodium tripolyphosphate is the sole Electrolyte; 26 to 31 illustrate various Builders and mixtures thereof; 32 is a high Builder to Active Formulation; 33 is an enzyme Formulation; 34 contains Hydrotrope; 35 has a triethanolamine salt of the surfactant; 36 to 38 illustrate olefin sulphonate and 39 to 42 paraffin sulphonate Formulations, in each case with successively increased Electrolyte; 43 to 46 illustrate type B formulations, 43 at three Pay Loads and 44 to 46 with increasing Electrolyte; 47 corresponds to Type B Formulation obtained after centrifuging 43 at low Pay Load for only three hours; 48 and 49 illustrate low foam Type A and C Formulations respectively; 50 to 54 illustrate various Type C Formulations; 55 is a Type C Formulation with cationic fabric softener; 56 illustrates a branched chain alkyl benzene sulphonate, 57 coconut diethanolamide and 58 a non-ionic free formulation; 59 and 60 illustrate the use of phosphonate builders; 61 to 62 relate to formulations particularly adapted to different parts of the North American market, being respectively phosphate free and high phosphate; 63 to 66 are formulations adapted to the needs of certain Asian markets.

Comparative Example A represents a commercial Formulation currently being marketed in Europe corresponding to Australian Pat. No. 522983. The comparative example was the material as purchased, except for the neutron scattering results carried out on a sample prepared in accordance with Example 1 to match the commercial Formulation as analyzed and using deuterium oxide instead of water. The composition, by analysis, follows:

| A. Corresponding to Australian P. 522983 (Example 1) | % |
|---|---|
| Sodium C10–14 linear alkylbenzene sulphonate | 12 |
| Sodium salt of three mole ethoxylate of C12–15 alcohol sulphate | 3 |
| Sodium tripolyphosphate | 15 |
| Sodium carbonate | 2.5 |
| Optical brightener (Tinopal LMS) | 0.5 |
| Sodium carboxymethyl cellulose | 1.0 |
| Water | to 100 |

3. Example Test Results

The foregoing examples were subjected to various tests, the results of which are tabulated:

Note The Phases separated from the centrifuge test are numbered from the bottom (i.e. the densest layer) upwards.

Figure 12:
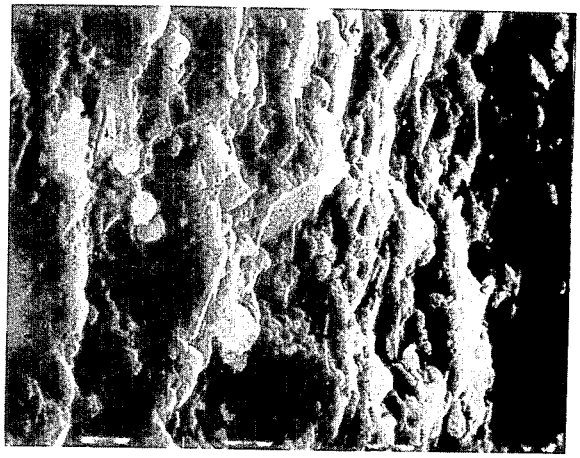

| | Examples | | | | | | | | | | | |
|---|---|---|---|---|---|---|---|---|---|---|---|---|
| | 1 | | 2 | | 3 | | 4 | | 5(a) | | 5(b) | |
| 1. Centrifuge Test Results | | | | | | | | | | | | |
| i. No. of Phases Separated | 1 | 2 | 1 | 2 | 1 | 2 | 1 | 2 | 1 | 2 | 1 | 2 |
| ii. Description | Opaque solid/paste | clear thin liquid | Opaque solid/paste | clear thin liquid | Opaque solid/paste | clear thin liquid | Opaque solid/paste | clear thin liquid | Opaque solid/paste | clear thin liquid | Opaque solid/paste | clear thin liquid |
| iii. Proportion (%) | 80.9 | 19.1 | — | | — | — | — | — | 75 | 25 | 81.7 | 18.3 |
| iv. Surfactant content (%) | — | <0.1 | — | | — | — | — | — | — | <0.1 | — | <0.1 |
| v. Loss on drying at 110° C. (%) | — | 74.8 | — | | — | — | — | — | — | 77.3 | — | 75.7 |
| vi. Viscosity (Pa.s) at 20° C. | — | 0.01 | — | | — | — | — | — | — | 0.01 | — | 0.01 |
| 2. Classification (Group) by Centrifuging | 111 | | 111 | | 111 | | 111 | | 111 | | 111 | |
| 3. Viscosity (Pa.s) | — | | — | | — | | — | | 1.70 | | 2.60 | |
| 4. Yield Points (Dynes/cm$^2$) | — | | — | | — | | — | | 12 | | 36 | |
| 5. Neutron Diffraction Results | | | | | | | | | | | | |
| 1. Micellar scattering | | | | | | | | | Present - narrow | | | |
| ii. a No. of other peaks | | | | | | | | | one | | | |
| b Description | — | | — | | | | | | narrow | | | |
| c Structural repeat distance (Å) | | | | | | | | | 33.4Å | | | |
| iii. Suggested Structure | | | | | | | | | lamellar hydrated solid See FIG. 1 | | | |
| 6. X-ray Diffraction Results | | | | | | | | | | | | |
| i. Micellar scattering | | | | | | | | | | | | |
| ii. a No. of other peaks | | | | | | | | | | | | |
| b Description | — | | — | | | | | | | | | |
| c Structural repeat distance (Å) | | | | | | | | | | | | |
| iii. Suggested Structure | | | | | | | | | | | | |
| 7. Electron Microscopy Results | | | | | | | | | | | | |
| i. Corresponding Figure No. | — | | — | | | | | | | | FIG. 12 | |
| ii. Description | | | | | | | | | | | Lamellar Features | |
| 8. Mobility | Pourable | | Pourable | | Pourable | | Pourable | | Readily Pourable | | Pourable | |
| 9. Stability | No sedimentation over over 12 months at ambient laboratory temp. | | No sedimentation over 12 months at ambient laboratory temperature | | No sedimentation over 12 months at ambient temperature | | No sedimentation over 12 months at ambient temp. | | No sedimentation over 12 months at ambient temp. | | No sedimentation over 12 at ambient also 3 months at 0° and 37° C. | |

| | Examples | | | | | | | | | |
|---|---|---|---|---|---|---|---|---|---|---|
| | 5(c) | | 6 | | 7 | | 8 | | 9(a) | |
| 1. Centrifuge Test Results | | | | | | | | | | |
| i. No. of Phases Separated | 1 | 2 | 1 | 2 | 1 | 2 | 1 | 2 | 1 | 2 |
| ii. Description | Opaque solid/paste | Clear thin liquid | Opaque solid/paste | Clear thin liquid | Opaque solid/paste | clear thin liquid | Opaque solid/paste | Clear thin liquid | Opaque solid/paste | Clear thin liquid |
| iii. Proportion (%) | 86 | 14% | — | — | — | — | — | — | — | — |
| iv. Surfactant content (%) | — | <0.1 | — | — | — | — | — | — | — | — |
| v. Loss on drying at 110° C. (%) | — | 74% | — | — | — | — | — | — | — | — |
| vi. Viscosity (Pa.s) at 20° C. | — | 0.01 | — | — | — | — | — | — | — | — |
| 2. Classification (Group) by Centrifuging | 111 | | 111 | | 111 | | 111 | | 111 | |
| 3. Viscosity (Pa.s) | 4.86 | | 4.58 | | 3.04 | | 2.84 | | 4.00 | |

-continued

| | | | | | |
|---|---|---|---|---|---|
| 4. Yield Points (Dynes/cm$^2$) | 178 | — | — | — | — |
| 5. Neutron Diffraction Results | | | | | |
| i. Micellar scattering | Present - narrow | | | | |
| ii. a No. of other peaks | two | | | | |
| b Description | Narrow, Broad | | | | |
| c Structural repeat distance (Å) | 34.9Å, 26.7Å | | | | |
| iii. Suggested Structure | 2 Discrete lamellar structures | | | | |
| 6. X-ray Diffraction Results | | | | | |
| i. Micellar scattering | Present | | | | |
| ii. a No. of other peaks | one | | | | |
| b Description | narrow | | | | |
| c Structural repeat distance (Å) | 31Å | | | | |
| iii. Suggested Structure | on ageing time two lamellar structures have merged. | | | | |
| 7. Electron Microscopy Results | | | | | |
| i. Corresponding Figure No. | | | | | |
| ii. Description | | | | | |
| 8. Mobility | Viscous but Pourble | Pourable | Pourable | Pourable | Pourable |
| 9. Stability | No sedimentation over 12 months at ambient temp. | No sedimentation over 12 months at ambient temp. | No sedimentation over 12 months at ambient temp. | No sedimentation over 12 months at ambient temp. | No sedimentation over 12 months at ambient temp. |

| | Examples | | | | | | | | | |
|---|---|---|---|---|---|---|---|---|---|---|
| | 9(b) | | 10(a) | | 10(b) | | 11 | | 12 | |
| 1. Centrifuge Test Results | | | | | | | | | | |
| i. No. of Phases Separated | 1 | 2 | 1 | 2 | 1 | 2 | 1 | 2 | 1 | 2 |
| ii. Description | Opaque solid/paste | clear thin liquid | Opaque solid/paste | clear thin liquid | Opaque solid/paste | clear thin liquid | Opaque solid/paste | clear thin liquid | Opaque solid/paste | clear thin liquid |
| iii. Proportion (%) | — | — | — | — | — | — | — | — | — | — |
| iv. Surfactant content (%) | — | — | — | — | — | — | — | — | — | — |
| v. Loss on drying at 110° C. (%) | — | — | — | — | — | — | — | — | — | — |
| vi. Viscosity (Pa.s) at 20° C. | — | — | — | — | — | — | — | — | — | — |
| 2. Classification (Group) by Centrifuging | 111 | | 111 | | 111 | | 111 | | 111 | |
| 3. Viscosity (Pa.s) | 8.75 | | 3.85 | | 8.00 | | 2.48 | | 0.93 | |
| 4. Yield Points (Dynes/cm$^2$) | | | | | | | — | | — | |
| 5. Neutron Diffraction Results | | | | | | | | | | |
| i. Micellar scattering | | | | | | | | | | |
| ii. a No. of other peaks | | | | | | | | | | |
| b Description | | | | | | | | | | |
| c Structural repeat distance (Å) | | | | | | | | | | |
| iii. Suggested Structure | | | | | | | | | | |
| 6. X-ray Diffraction Results | | | | | | | | | | |
| i. Micellar scattering | | | | | | | | | | |
| ii. a No. of other peaks | | | | | | | | | | |
| b Description | | | | | | | | | | |
| c Structural repeat distance (Å) | | | | | | | | | | |
| iii. Suggested Structure | | | | | | | | | | |
| 7. Electron Microscopy Results | | | | | | | | | | |
| i. Corresponding Figure No. | | | | | | | | | | |

-continued

| | | | | | | | | | | | |
|---|---|---|---|---|---|---|---|---|---|---|---|
| ii. Description | | | | | | | | | | | |
| 8. Mobility | Viscous but pourable | | Pourable | | Viscous but pourable | | Pourable | | | Readily Pourable | |
| 9. Stability | No sedimentation over 12 months at ambient temp. | | No sedimentation over 12 months at ambient temp. | | No sedimentation over 12 months at ambient temp. | | No sedimentation over 12 months at ambient temp. | | | No sedimentation over 12 months at ambient temp. | |
| | Examples | | | | | | | | | | |
| | 13 | | 14 | | 15 | | 16 | | | 17 | |
| 1. Centrifuge Test Results | | | | | | | | | | | |
| i. No. of Phases Separated | 1 | 2 | 1 | 2 | 1 | 2 | 1 | 2 | 3 | 1 | 2 |
| ii. Description | Opaque solid/paste | clear thin liquid | Opaque solid/paste | clear thin liquid | Opaque solid/paste | clear thin liquid | Opaque solid/paste | clear thin liquid | solid | Opaque solid/paste | clear thin liquid |
| iii. Proportion (%) | — | — | 92.4% (w/w) | 7.6% | — | — | 72 (vol/vol) | 12 | 16 | 65.5 | 34.5 |
| iv. Surfactant content (%) | — | — | — | 1.7% | — | — | | 0.3 | | | 7.9 |
| v. Loss on drying at 110° C. (%) | — | — | — | 80.7% | — | — | | 76.3 | | | 72.1 |
| vi. Viscosity (Pa.s) at 20° C. | — | — | — | 0.01 | — | — | | | | | |
| 2. Classification (Group) by Centrifuging | 111 | | 111 | | 111 | | 111 | | | 111 | |
| 3. Viscosity (Pa.s) | — | | 1.95 | | 3.00 | | 2.97 | | | 5.15 | |
| 4. Yield Points (Dynes/cm$^2$) | 48 | | — | | — | | — | | | — | |
| 5. Neutron Diffraction Results | | | | | | | | | | | |
| i. Micellar scattering | | | | | | | | | | | |
| ii. a No. of other peaks | | | | | | | | | | | |
| b Description | | | | | | | | | | | |
| c Structural repeat distance (Å) | | | | | | | | | | | |
| iii. Suggested Structure | | | | | | | | | | | |
| 6. X-ray Diffraction Results | | | | | | | | | | | |
| i. Micellar scattering | | | | | | | | | | | |
| ii. a No. of other peaks | | | | | | | | | | | |
| b Description | | | | | | | | | | | |
| c Structural repeat distance (Å) | | | | | | | | | | | |
| iii. Suggested Structure | | | | | | | | | | | |
| 7. Electron Microscopy Results | | | | | | | | | | | |
| i. Corresponding Figure No. | | | | | | | | | | | |
| ii. Description | | | | | | | | | | | |
| 8. Mobility | Viscous but Pourable | | Pourable | | Viscous but Pourable | | Pourable | | | Viscous but Pourable | |
| 9. Stability | No sedimentation over 12 months at ambient temp. | | No sedimentation over 12 months at ambient temp. | | No sedimentation over 6 months at ambient temp. | | No sedimentation over 5 months at ambient temp. | | | No sedimentation over 10 months at ambient temp. | |
| | Examples | | | | | | | | | | |
| | 18 | | 19 | | 20 | | 21 | | | 22 | |
| 1. Centrifuge Test Results | | | | | | | | | | | |
| i. No. of Phases Separated | 1 | 2 | 1 | 2 | 1 | 2 | 1 | 2 | | 1 | 2 |
| ii. Description | Opaque solid/paste | clear viscous liquid | Opaque solid/paste | clear thin liquid | Opaque solid/paste | clear thin liquid | Opaque solid/paste | clear thin liquid | | Opaque solid/paste | clear thin liquid |
| iii. Proportion (%) | 90(vol/vol) | 10 | | | 75 | 25 | 78 | 22 | | 75 | 25 |
| iv. Surfactant content (%) | — | — | — | <0.1% | — | <0.1 | — | <0.1 | | — | 0.4 |
| v. Loss on drying at 110° C. (%) | — | — | — | 74.7% | — | 74.6 | — | 79.6 | | — | 79.1 |
| vi. Viscosity (Pa.s) at 20° C. | — | — | — | 0.01 | — | 0.01 | — | 0.01 | | — | 0.01 |
| 2. Classification (Group) by Centrifuging | 111 | | 111 | | 111 | | 111 | | | 111 | |

-continued

Figure 2:
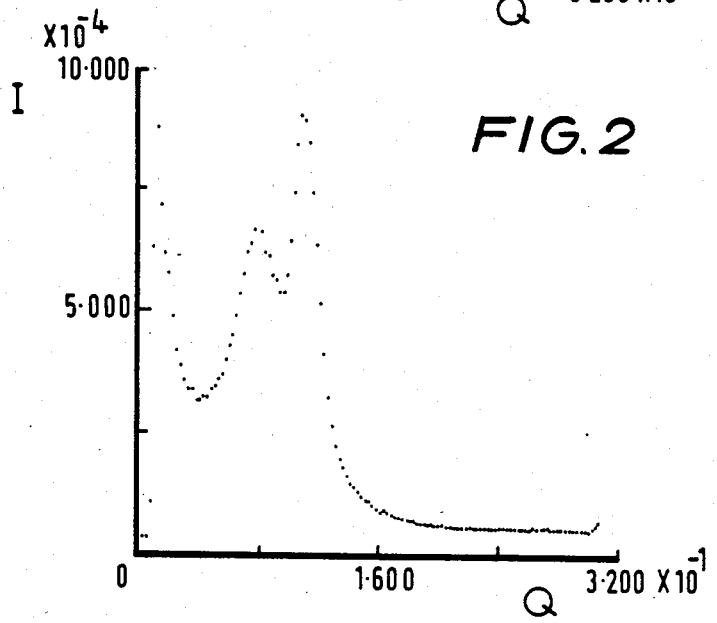
Figure 3:
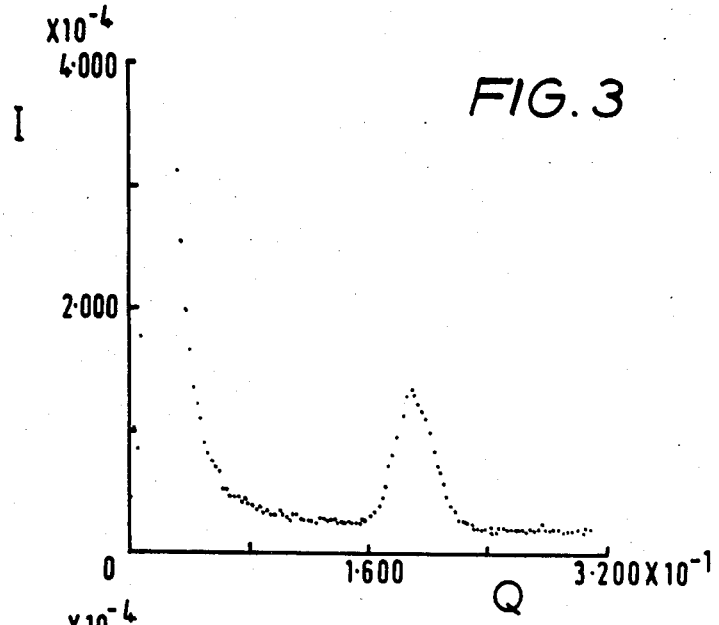

| | | | | | |
|---|---|---|---|---|---|
| 3. Viscosity (Pa.s) | 6.46 | 2.20 | 2.60 | 4.28 | 2.48 |
| 4. Yield Points (Dynes/cm$^2$) | 4 | 36 | — | — | — |
| 5. Neutron Diffraction Results | | | | | |
| i. Micellar scattering | Present & includes peak | | | Present | |
| ii. a No. of other peaks | one | | | one | |
| b Description | very narrow | | | sharp | |
| c Structural repeat distance (Å) | 57.6Å | | | 33.4Å | |
| iii. Suggested Structure | Micellar + "G" Phase (see FIG. 2) | | | lamellar hydrated solid (See FIG. 3) | |
| 6. X-ray Diffraction Results | | | | | |
| i. Micellar scattering | very broad | | | Present | |
| ii. a No. of other peaks | two | | | one | |
| b Description | Narrow at 50Å, Broad at 26Å | | | sharp | |
| c Structural repeat distance (Å) | 50Å | | | 32Å | |
| iii. Suggested Structure | Micellar + "G" Phase | | | lamellar hydrated solid | |
| 7. Electron Microscopy Results | | | | | |
| i. Corresponding Figure No. | | | | | |
| ii. Description | | | | | |
| 8. Mobility | Viscous but pourable | Pourable | Pourable | Viscous but Pourable | Pourable |
| 9. Stability | No sedimentation over 6 months at ambient temp. | No sedimentation over 6 months at ambient temp. | No sedimentation over 12 months at ambient temp. also 3 months at 0 & 37° C. | No sedimentation over 12 months at ambient temp. also 3 months at 0 & 37° C. | No sedimentation over 12 months at ambient temp. also 3 months at 0 & 37° C. |

Figure 4:
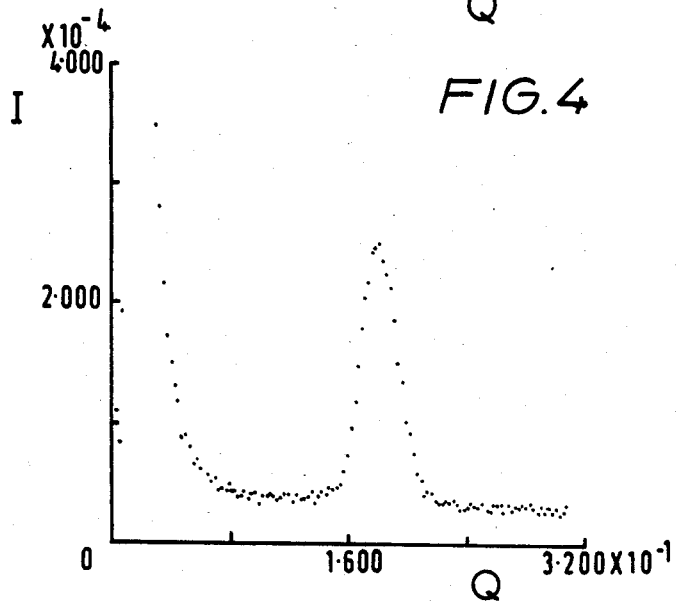

| | Examples | | | | | | | | | |
|---|---|---|---|---|---|---|---|---|---|---|
| | 23 | | 24(a) | | 24(b) | | 24(c) | | 25 | |
| 1. Centrifuge Test Results | | | | | | | | | | |
| i. No. of Phases Separated | 1 | 2 | 1 | 2 | 1 | 2 | 1 | 2 | 1 | 2 |
| ii. Description | Opaque solid/paste | clear thin liquid | Opaque solid/paste | clear thin liquid | Opaque solid/paste | clear thin liquid | Opaque solid/paste | clear thin liquid | Opaque solid/paste | clear thin liquid |
| iii. Proportion (%) | 70 | 30 | — | — | — | — | — | — | 60(vol/vol) | 40 |
| iv. Surfactant content (%) | — | <0.1 | — | <0.1 | — | <0.1 | — | <0.1 | — | <0.1 |
| v. Loss on drying at 110° C. (%) | — | 70.4 | — | 84 | — | 82.9 | — | 80 | — | 84.6 |
| vi. Viscosity (Pa.s) at 20° C. | — | 0.01 | — | 0.01 | — | 0.01 | — | 0.01 | — | 0.01 |
| 2. Classification (Group) by Centrifuging | 111 | | 111 | | 111 | | 111 | | 111 | |
| 3. Viscosity (Pa.s) | 3.21 | | 0.88 | | 1.87 | | 2.38 | | 2.20 | |
| 4. Yield Points (Dynes/cm$^2$) | — | | — | | — | | — | | — | |
| 5. Neutron Diffraction Results | | | | | | | | | | |
| i. Micellar scattering | | | | | | | | | present - narrow | |
| ii. a No. of other peaks | | | | | | | | | one | |
| b Description | | | | | | | | | sharp | |
| c Structural repeat distance (Å) | | | | | | | | | 34.5Å | |
| iii. Suggested Structure | | | | | | | | | lamellar hydrated solid (see FIG. 4) | |
| 6. X-ray Diffraction Results | | | | | | | | | | |
| i. Micellar scattering | | | | | | | | | Present | |
| ii. a No. of other peaks | | | | | | | | | one | |
| b Description | | | | | | | | | sharp | |
| c Structural repeat distance (Å) | | | | | | | | | 33Å | |
| iii. Suggested Structure | | | | | | | | | lamellar hydrated solid | |

-continued

| | | | | | |
|---|---|---|---|---|---|
| 7. Electron Microscopy Results | | | | | |
| i. Corresponding Figure No. | | | | | |
| ii. Description | | | | | |
| 8. Mobility | Pourable | Readily Pourable | Pourable | Pourable | Pourable |
| 9. Stability | No sedimentation over 12 at ambient temp. also 3 months at 0 & 37° C. | No sedimentation over 3 months at ambient temp. | No sedimentation over 12 months at ambient temp. | No sedimentation over 12 months at ambient temp. | No sedimentation over 9 months at ambient temp. |

| | Examples | | | | | | | | | | | |
|---|---|---|---|---|---|---|---|---|---|---|---|---|
| | 26 | | 27 | | 28 | | | 29 | | 30 | | |
| 1. Centrifuge Test Results | | | | | | | | | | | | |
| i. No. of Phases Separated | 1 | 2 | 1 | 2 | 1 | 2 | 3 | 1 | 2 | 1 | 2 | 3 |
| ii. Description | Opaque solid/paste | clear thin liquid | Opaque solid/paste | clear thin liquid | Opaque solid/paste | clear thin liquid | solid | Opaque solid/paste | clear thin liquid | Opaque solid/paste | clear thin liquid | solid |
| iii. Proportion (%) | — | — | — | — | 20(vol/vol) | 35 | 45 | 74 | 26 | 50(vol/vol) | 20 | 30 |
| iv. Surfactant content (%) | — | — | — | — | | | | | 0.8 | | | |
| v. Loss on drying at 110° C. (%) | — | — | — | — | | | | | 58.5 | | | |
| vi. Viscosity (Pa.s) at 20° C. | — | — | — | — | | | | | | | | |
| 2. Classification (Group) by Centrifuging | 111 | | 111 | | 111 | | | 111 | | 111 | | |
| 3. Viscosity (Pa.s) | 1.99 | | 1.31 | | 6.91 | | | 8.46 | | 3.11 | | |
| 4. Yield Points (Dynes/cm$^2$) | — | | — | | — | | | — | | — | | |
| 5. Neutron Diffraction Results | | | | | | | | | | | | |
| i. Micellar scattering | | | | | | | | | | | | |
| ii. a No. of other peaks | | | | | | | | | | | | |
| b Description | | | | | | | | | | | | |
| c Structural repeat distance (Å) | | | | | | | | | | | | |
| iii. Suggested Structure | | | | | | | | | | | | |
| 6. X-ray Diffraction Results | | | | | | | | | | | | |
| i. Micellar scattering | | | | | | | | | | | | |
| ii. a No. of other peaks | | | | | | | | | | | | |
| b Description | | | | | | | | | | | | |
| c Structural repeat distance (Å) | | | | | | | | | | | | |
| iii. Suggested Structure | | | | | | | | | | | | |
| 7. Electron Microscopy Results | | | | | | | | | | | | |
| i. Corresponding Figure No. | | | | | | | | | | | | |
| ii. Description | | | | | | | | | | | | |
| 8. Mobility | Pourable | | Readily Pourable | | Viscous but pourable | | | Viscous but pourable | | Pourable | | |
| 9. Stability | No sedimentation over 6 months at ambient temp. | | No sedimentation over 2 months at ambient temp. | | No sedimentation over 9 months at ambient temp. | | | No sedimentation over 3 months at ambient temp. | | No sedimentation over 1 month at ambient temp. | | |

| | Examples | | | | | | | | | |
|---|---|---|---|---|---|---|---|---|---|---|
| | 31 | | 32 | | 33 | | 34 | | 35 | |
| 1. Centrifuge Test Results | | | | | | | | | | |
| i. No. of Phases Separated | 1 | 2 | 1 | 2 | 1 | 2 | 1 | 2 | 1 | 2 |
| ii. Description | Opaque solid/paste | clear thin liquid | Opaque solid/paste | clear thin liquid | Opaque solid/paste | clear thin liquid | Opaque solid/paste | cloudy, thick liquid | Opaque solid/paste | clear thin liquid |
| iii. Proportion (%) | — | — | 87 | 13 | 80 | 20 | 72 | 28 | — | — |
| iv. Surfactant content (%) | | — | | 0.1 | — | <0.1 | — | 27 | — | — |

-continued

| | | | | | | | | | | | |
|---|---|---|---|---|---|---|---|---|---|---|---|
| v. Loss on drying at 110° C. (%) | | — | | 75 | — | | — | — | 45 | — | — |
| vi. Viscosity (Pa.s) at 20° C. | | | | 0.01 | — | | 0.01 | — | 0.3 | — | — |
| 2. Classification (Group) by Centrifuging | 111 | | 111 | | 111 | | | 111 | | 111 | |
| 3. Viscosity (Pa.s) | 0.33 | | 6.50 | | 2.63 | | | 7.0 | | 1.10 | |
| 4. Yield Points (Dynes/cm$^2$) | — | | — | | — | | | — | | 3 | |
| 5. Neutron Diffraction Results | | | | | | | | | | | |
| i. Micellar scattering | | | | | | | | | | | |
| ii. a No. of other peaks | | | | | | | | | | | |
| b Description | | | | | | | | | | | |
| c Structural repeat distance (Å) | | | | | | | | | | | |
| iii. Suggested Structure | | | | | | | | | | | |
| 6. X-ray Diffraction Results | | | | | | | | | | | |
| i. Micellar scattering | | | | | | | | | | | |
| ii. a No. of other peaks | | | | | | | | | | | |
| b Description | | | | | | | | | | | |
| c Structural repeat distance (Å) | | | | | | | | | | | |
| iii. Suggested Structure | | | | | | | | | | | |
| 7. Electron Microscopy Results | | | | | | | | | | | |
| i. Corresponding Figure No. | | | | | | | | | | | |
| ii. Description | | | | | | | | | | | |
| 8. Mobility | Readily Pourable | | Viscous but Pourable | | Pourable | | | Viscous but Pourable | | Readily Pourable | |
| 9. Stability | No sedimentation over 2 months at ambient temp. | | No sedimentation over 12 months at ambient temp. | | No sedimentation over 12 months at ambient temp. | | | No sedimentation over 9 months at ambient temp. | | No sedimentation over 4 months at ambient temp. | |

Figure 5:
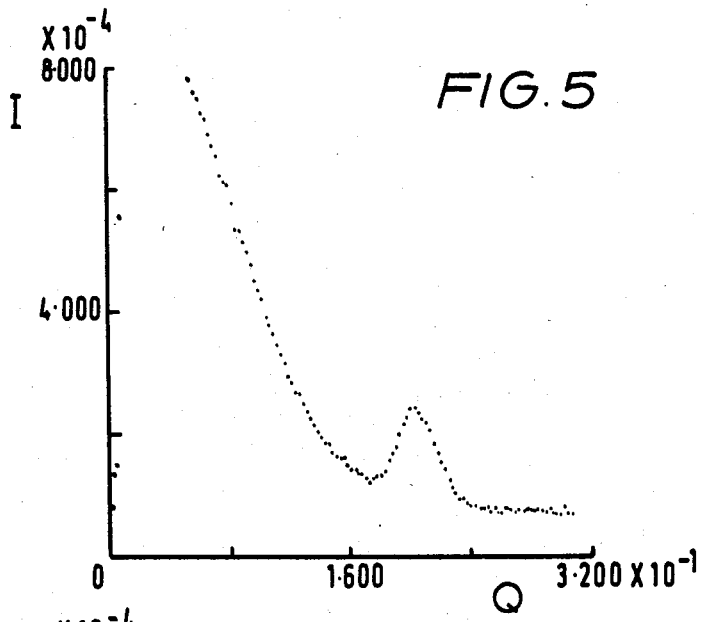
Figure 6:
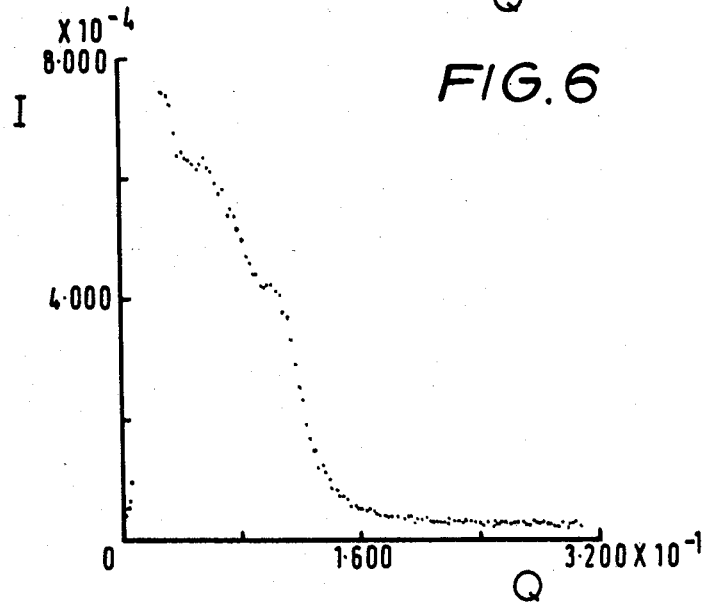

| | Examples | | | | | | | | | | |
|---|---|---|---|---|---|---|---|---|---|---|---|
| | 36 | | 37 | | 38 | | | 39 | | 40 | |
| 1. Centrifuge Test Results | | | | | | | | | | | |
| i. No. of Phases Separated | 1 | 2 | 1 | 2 | 1 | 2 | 3 | 1 | 2 | 1 | 2 |
| ii. Description | Opaque solid/paste | cloudy viscous liquid | Opaque solid/paste | cloudy viscous liquid | Opaque solid/paste | clear thin liquid | Viscous liquid | Opaque solid/paste | Clear viscous liquid | Opaque solid/paste | clear viscous liquid |
| iii. Proportion (%) | 75(vol/vol) | 25 | 85(vol/vol) | 15 | — | — | — | 66 | 34 | 77 | 23 |
| iv. Surfactant content (%) | — | 16.7 | — | 15.0 | — | — | — | — | 12 | — | 10 |
| v. Loss on drying at 110° C. (%) | — | 65.5 | — | 59.3 | — | — | — | — | 68 | — | 61 |
| vi. Viscosity (Pa.s) at 20° C. | — | 1 | — | 0.5 | — | — | — | — | 0.15 | — | 0.15 |
| 2. Classification (Group) by Centrifuging | 111 | | 111 | | 11 | | | 111 | | 111 | |
| 3. Viscosity (Pa.s) | 3.70 | | 6.36 | | 3.74 | | | 3.10 | | 2.87 | |
| 4. Yield Points (Dynes/cm$^2$) | 0.5 to 2 | | 0.5 to 2 | | 0.5 to 2 | | | <0.5 | | <0.5 | |
| 5. Neutron Diffraction Results | | | | | | | | | | | |
| i. Micellar scattering | very broad with superimposed peak | | | | | | | Present very broad | | | |
| ii. a No. of other peaks | one | | | | | | | one | | | |
| b Description | narrow | | | | | | | broad | | | |
| c Structural repeat distance (Å) | 61Å | | | | | | | 31Å | | | |
| iii. Suggested Structure | micellar "G" phase (see FIG. 6) | | | | | | | micellar + "G" phase (see FIG. 5) | | | |
| 6. X-ray Diffraction Results | | | | | | | | | | | |
| i. Micellar scattering | Present | | | | | | | Present very broad | | | |
| ii. a No. of other peaks | two | | | | | | | one | | | |
| b Description | sharp, sharp | | | | | | | sharp | | | |

-continued

Figure 13:
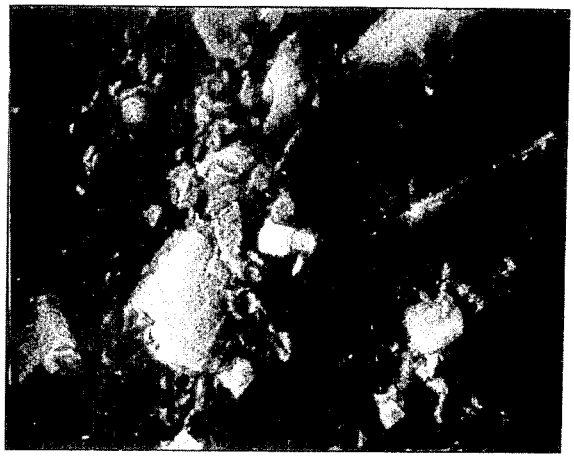

| | | | | | |
|---|---|---|---|---|---|
| c Structural repeat distance (Å) | 57, 38Å | | | 28.5Å | |
| iii. Suggested Structure | micellar phase + "G" phase | | | micellar + "G" phase | |
| 7. Electron Microscopy Results | | | | | |
| i. Corresponding Figure No. | FIG. 13 | | | | |
| ii. Description | Lamellar features some concentric structures | | | | |
| 8. Mobility | Viscous but Pourable | Viscous but Pourable | Pourable | Pourable | Pourable |
| 9. Stability | No sedimentation over 6 months at ambient temp. | No sedimentation over 9 months at ambient temp. | No sedimentation over 9 months at ambient temp. | No sedimentation over 12 months at ambient temp. | No sedimentation over 9 months at ambient temp. |

Figure 14:
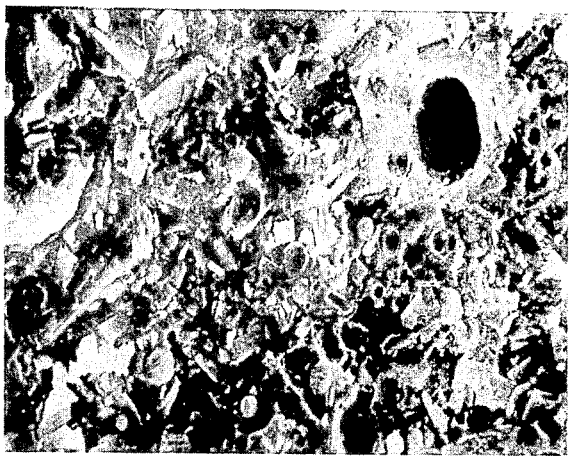
Figure 15:
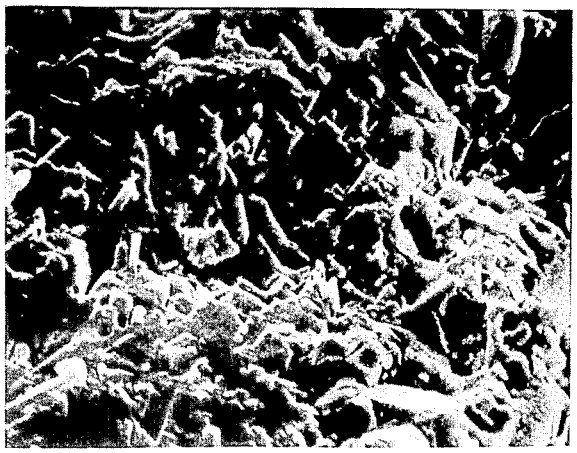

| | Examples | | | | | | | | | | | |
|---|---|---|---|---|---|---|---|---|---|---|---|---|
| | 41 | | | 42 | | | 43(a) | | 43(b) | | 43(c) | |
| 1. Centrifuge Test Results | | | | | | | | | | | | |
| i. No. of Phases Separated | 1 | 2 | 3 | 1 | 2 | 3 | 1 | 2 | 1 | 2 | 1 | 2 |
| ii. Description | Opaque solid/paste | liquid | Opaque gelled solid | Opaque solid/paste | thin liquid | opaque gelled solid | Opaque solid/paste | clear viscous liquid | Opaque solid/paste | clear viscous liquid | Opaque solid/paste | clear viscous liquid |
| iii. Proportion (%) | — | — | — | — | — | — | 58.0 | 42.0 | — | — | | |
| iv. Surfactant content (%) | — | 4.4 | — | — | — | — | — | 3.0 | — | — | | |
| v. Loss on drying at 110° C. (%) | — | 58.1 | — | — | — | — | — | 91.4 | — | — | | |
| vi. Viscosity (Pa.s) at 20° C. | — | 0.07 | | — | — | — | — | — | — | — | | |
| 2. Classification (Group) by Centrifuging | 111 | | | 111 | | | 111 | | 111 | | 111 | |
| 3. Viscosity (Pa.s) | 3.21 | | | 4.10 | | | 0.73 | | 0.97 | | 1.72 | |
| 4. Yield Points (Dynes/cm$^2$) | <0.5 | | | 4 | | | — | | — | | — | |
| 5. Neutron Diffraction Results | | | | | | | | | | | | |
| i. Micellar scattering | | | | | | | | | | | | |
| ii. a No. of other peaks | | | | | | | | | | | | |
| b Description | | | | | | | | | | | | |
| c Structural repeat distance (Å) | | | | | | | | | | | | |
| iii. Suggested Structure | | | | | | | | | | | | |
| 6. X-ray Diffraction Results | | | | | | | | | | | | |
| i. Micellar scattering | | | | | | | | | | | | |
| ii. a No. of other peaks | | | | | | | | | | | | |
| b Description | | | | | | | | | | | | |
| c Structural repeat distance (Å) | | | | | | | | | | | | |
| iii. Suggested Structure | | | | | | | | | | | | |
| 7. Electron Microscopy Results | | | | | | | | | | | | |
| i. Corresponding Figure No. | FIGS. 14 and 15 | | | | | | | | | | | |
| ii. Description | Lamellar and Spheroidal features | | | | | | | | | | | |
| 8. Mobility | Pourable | | | Viscous but Pourable | | | Viscous but Pourable | | Viscous but Pourable | | Viscous but Pourable | |
| 9. Stability | No sedimentation over 6 months at ambient temp. | | | No sedimentation over 4 months at ambient temp. | | | No sedimentation over 12 months at ambient temp. | | No sedimentation over 12 months at ambient temp. | | No sedimentation over 12 months at ambient temp. | |

| | Examples | | | | | | | | | | | | |
|---|---|---|---|---|---|---|---|---|---|---|---|---|---|
| | 44 | | | 45 | | | 46 | | | 47 | | 48(a) | |
| 1. Centrifuge Test Results | | | | | | | | | | | | | |
| i. No. of Phases Separated | 1 | 2 | 3 | 1 | 2 | 3 | 1 | 2 | 3 | 1 | 2 | 1 | 2 |
| ii. Description | Opaque | clear | clear | Opaque | clear | clear | Opaque | clear | clear | Opaque | clear | Opaque | Thin |

-continued

| | | | | | | | | | | | | | |
|---|---|---|---|---|---|---|---|---|---|---|---|---|---|
| | solid/paste | thin liquid | viscous liquid | solid/paste | thin liquid | viscous liquid | solid/paste | thin liquid | viscous liquid | solid/paste | viscous liquid | solid/paste | clear liquid |
| iii. Proportion (%) | | | | 30(v/v) | 60 | 10 | 40(v/v) | 50 | 10 | | | 78.0 | 22 |
| iv. Surfactant content (%) | | | | | | | | | | | | | 0.1 |
| v. Loss on drying at 110° C. (%) | | | | | | | | | | | | | 80 |
| vi. Viscosity (Pa.s) at 20° C. | | | | | | | | | | | | | 0.01 |
| 2. Classification (Group) by Centrifuging | | 11 | | | 11 | | | 11 | | 111 | | 111 | |
| 3. Viscosity (Pa.s) | | 1.19 | | | 2.74 | | | 2.48 | | 11.0 | | 1.58 | |
| 4. Yield Points (Dynes/cm$^2$) | | — | | | — | | | — | | — | | — | |
| 5. Neutron Diffraction Results | | | | | | | | | | | | | |
| i. Micellar scattering | | | | | | | | | | | | | |
| ii. a No. of other peaks | | | | | | | | | | | | | |
| b Description | | | | | | | | | | | | | |
| c Structural repeat distance (Å) | | | | | | | | | | | | | |
| iii. Suggested Structure | | | | | | | | | | | | | |
| 6. X-ray Diffraction Results | | | | | | | | | | | | | |
| i. Micellar scattering | | | | | | | | | | | | | |
| ii. a No. of other peaks | | | | | | | | | | | | | |
| b Description | | | | | | | | | | | | | |
| c Structural repeat distance (Å) | | | | | | | | | | | | | |
| iii. Suggested Structure | | | | | | | | | | | | | |
| 7. Electron Microscopy Results | | | | | | | | | | | | | |
| i. Corresponding Figure No. | | | | | | | | | | | | | |
| ii. Description | | | | | | | | | | | | | |
| 8. Mobility | Viscous but Pourable | | | Viscous but Pourable | | | Viscous but Pourable | | | Viscous but Pourable | | Readily Pourable | |
| 9. Stability | No sedimentation over 9 months at ambient temp. | | | No sedimentation over 9 months at ambient temp. | | | No sedimentation over 9 months at ambient temp. | | | No sedimentation over 4 months at ambient temp. | | No sedimentation over 5 months at ambient temp. | |

Figure 7:
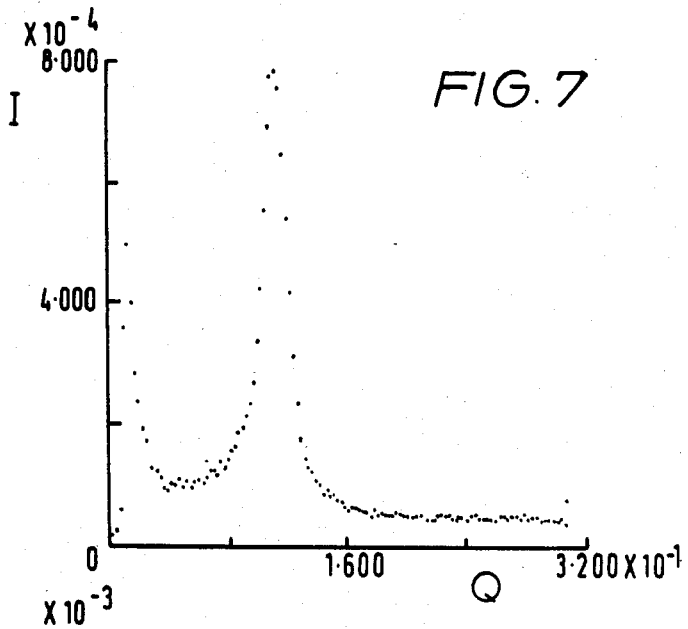

| | Examples | | | | | | | | | | |
|---|---|---|---|---|---|---|---|---|---|---|---|
| | 48(b) | | 48(c) | | 49 | | | 50(a) | | 50(b) | |
| 1. Centrifuge Test Results | | | | | | | | | | | |
| i. No. of Phases Separated | 1 | 2 | 1 | 2 | 1 | 2 | 3 | 1 | 2 | 1 | 2 |
| ii. Description | Opaque solid/paste | clear thin liquid | Opaque solid/paste | clear thin liquid | Opaque solid/paste | Clear thin liquid | waxy solid | Opaque solid/paste | clear thin liquid | Opaque solid/paste | clear thin liquid |
| iii. Proportion (%) | 80 | 20 | 82 | 18.0 | 31.9(v/v) | 23.4 | 44.7 | 76 | 24 | 77.5 | 22.5 |
| iv. Surfactant content (%) | — | <0.1 | — | <0.1 | — | <0.1 | 29.6 | | <0.1 | | <0.1 |
| v. Loss on drying at 110° C. (%) | — | 79. | — | 76.6 | — | 67.1 | 50.2 | | 81 | | 79.7 |
| vi. Viscosity (Pa.s) at 20° C. | — | <0.01 | | <0.01 | | <0.01 | — | | <0.01 | | <0.01 |
| 2. Classification (Group) by Centrifuging | 111 | | 111 | | 111 | | | 111 | | 111 | |
| 3. Viscosity (Pa.s) | 2.31 | | 3.65 | | 5.95 | | | 0.58 | | 1.60 | |
| 4. Yield Points (Dynes/cm$^2$) | | | | | | | | | | | |
| 5. Neutron Diffraction Results | | | | | | | | | | | |
| i. Micellar scattering | | | | | | | | | | very small | |
| ii. a No. of other peaks | | | | | | | | | | one | |
| b Description | | | | | | | | | | very narrow | |
| c Structural repeat distance (Å) | | | | | | | | | | 65Å | |
| iii. Suggested Structure | | | | | | | | | | Micellar + "G" phase ("G" predominates) see FIG. 7 | |
| 6. X-ray Diffraction Results | | | | | | | | | | | |

-continued

Figure 8:
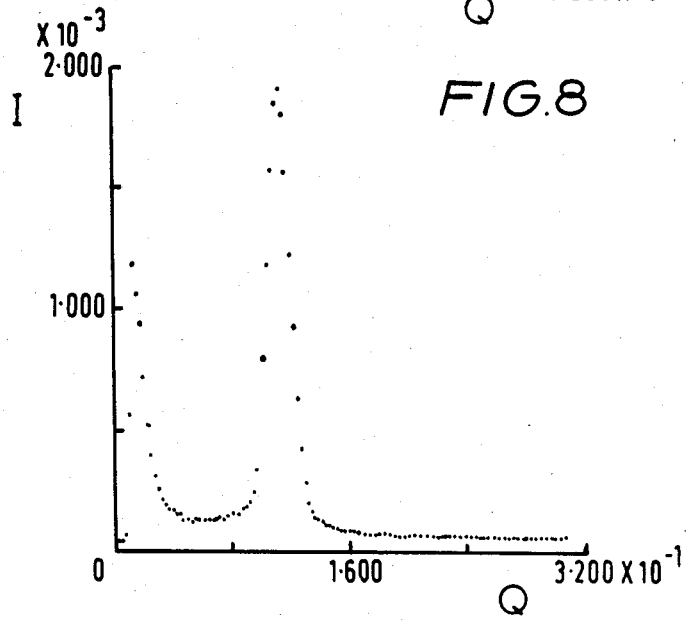
Figure 9:
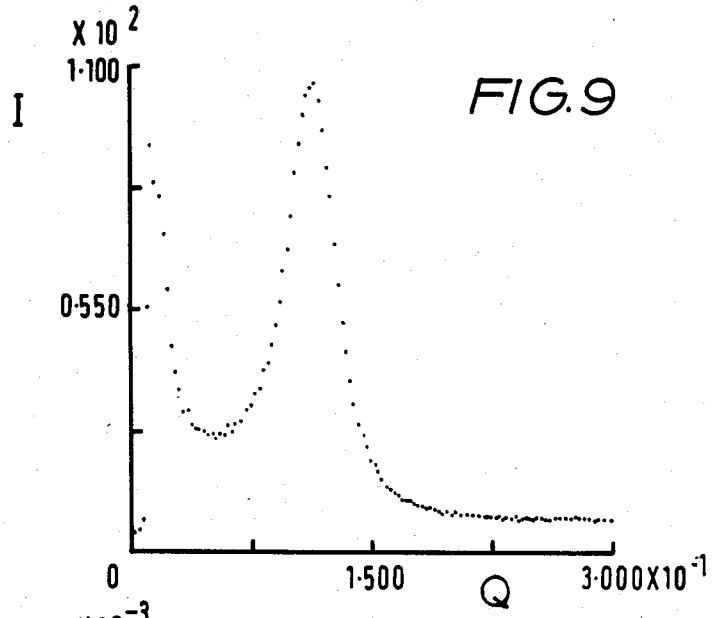
Figure 16:
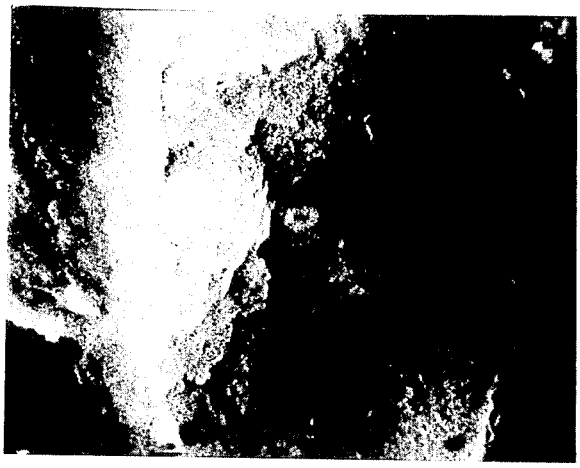

| | | | | | | | | | | | | | | |
|---|---|---|---|---|---|---|---|---|---|---|---|---|---|---|
| i. Micellar scattering | | | | | | | | | | | | | | very small |
| ii. a No. of other peaks | | | | | | | | | | | | | | two |
| b Description | | | | | | | | | | | | | | Narrow at 54Å, narrow at 28Å |
| c Structural repeat distance (Å) | | | | | | | | | | | | | | 54Å |
| iii. Suggested Structure | | | | | | | | | | | | | | "G" phase + some micellar |
| 7. Electron Microscopy Results | | | | | | | | | | | | | | |
| i. Corresponding Figure No. | | | | | | | | | | | | | | |
| ii. Description | | | | | | | | | | | | | | |
| 8. Mobility | Pourable | | Pourable | | | Viscous but pourable | | | Readily pourable | | | Pourable | | |
| 9. Stability | No sedimentation over 12 months at ambient temp. | | No sedimentation over 12 months at ambient temp. | | | No sedimentation over 12 months at ambient temp. | | | No sedimentation over 12 months at ambient temp. | | | No sedimentation over 12 months at ambient temp. | | |
| | Examples | | | | | | | | | | | | | |
| | 50(c) | | 51 | | | 52 | | | 53 | | | 54 | | |
| 1. Centrifuge Test Results | | | | | | | | | | | | | | |
| i. No. of Phases Separated | 1 | 2 | 1 | 2 | 3 | 1 | 2 | 3 | 1 | 2 | 3 | 1 | 2 | 3 |
| ii. Description | Opaque solid/paste | clear thin liquid | Opaque solid paste | clear thin liquid | clear oily layer | Opaque solid paste | clear thin liquid | cloudy viscous liquid("G") | Opaque solid paste | clear thin liquid | waxy solid | Opaque solid/ paste | clear thin liquid | waxy solid |
| iii. Proportion (%) | 80 | 20 | 59(v/v) | 39 | 2 | 45(v/v) | 19 | 36 | 36(v/v) | 30 | 34 | 43(v/v) | 19 | 38 |
| iv. Surfactant content (%) | | <0.1 | | | — | | 0.2 | 49 | | <0.1 | 31.5 | | <0.1 | 32.9 |
| v. Loss on drying at 110° C. (%) | | 78% | | | — | | 72 | 48 | | 82 | — | | 71.6 | 51.5 |
| vi. Viscosity (Pa.s) at 20° C. | | <0.01 | | | — | | <0.01 | >1.0 | | <0.01 | — | | <0.01 | — |
| 2. Classification (Group) by Centrifuging | 111 | | 11 | | | 11 | | | 111 | | | 111 | | |
| 3. Viscosity (Pa.s) | 3.89 | | 11.40 | | | 4.42 | | | 1.42 | | | 1.80 | | |
| 4. Yield Points (Dynes/cm$^2$) | | | — | | | 0.5 | | | 0.5 | | | <0.5 | | |
| 5. Neutron Diffraction Results | | | | | | | | | | | | | | |
| i. Micellar scattering | | | | | | narrow/strong | | | narrow-weak | | | | | |
| ii. a No. of other peaks | | | | | | one | | | one | | | | | |
| b Description | | | | | | broad | | | narrow | | | | | |
| c Structural repeat distance (Å) | | | | | | 54.2Å | | | 56.1Å | | | | | |
| iii. Suggested Structure | | | | | | micellar + "G" phase See FIG. 9 | | | "G" phase see FIG. 8 | | | | | |
| 6. X-ray Diffraction Results | | | | | | | | | | | | | | |
| i. Micellar scattering | | | | | | narrow | | | | | | | | |
| ii. a No. of other peaks | | | | | | two | | | | | | | | |
| b Description | | | | | | narrow at 51Å, narrow at 25Å | | | | | | | | |
| c Structural repeat distance (Å) | | | | | | 51Å | | | | | | | | |
| iii. Suggested Structure | | | | | | micellar "G" phase | | | | | | | | |
| 7. Electron Microscopy Results | | | | | | | | | | | | | | |
| i. Corresponding Figure No. | | | | | | | | | FIG. 16 | | | | | |
| ii. Description | | | | | | | | | Lamellar features | | | | | |
| 8. Mobility | Viscous but pourable | | Viscous but Pourable | | | Viscous but Pourable | | | Viscous but Pourable. | | | Pourable | | |
| 9. Stability | No sedimentation over 12 months at ambient temp. | | No sedimentation over 12 months at ambient temp. | | | No sedimentation over 5 months at ambient temp. | | | No sedimentation over 4 months at ambient temp. | | | No sedimentation over 4 months at ambient temp. | | |
| | Examples | | | | | | | | | | | | | |
| | 55 | | | 56 | | 57 | | | 58 | | | 50 | | 60 |
| 1. Centrifuge Test Results | | | | | | | | | | | | | | |
| i. No. of Phases Separated | 1 | 2 | 3 | 1 | 2 | 1 | 2 | | 1 | 2 | | 1 | 2 | |

-continued

| | | | | | | | | | | | | | |
|---|---|---|---|---|---|---|---|---|---|---|---|---|---|
| ii. Description | Opaque solid/ paste | clear thin liquid | waxy solid | Opaque solid/ paste | Clear thin liquid | Opaque solid/ paste | Clear thin liquid | Opaque solid/ paste | Clear thin liquid | Opaque solid/ paste | Clear thin liquid | Opaque solid/ paste | Clear thin liquid |
| iii. Proportion (%) | 40(v/v) | 27 | 33 | 76 | 24 | 82.5 | 17.5 | 64.9 | 35.1 | 77.0 | 23.0 | 73.0 | 27.0 |
| iv. Surfactant content (%) | | <0.2 | | | 0.05 | | 0.02 | | 0.3 | | 0.4 | | 0.1 |
| v. Loss on drying at 110° C. (%) | | 82.2 | | | | | | | | | | | |
| vi. Viscosity (Pa.s) at 20° C. | | | | | | | | | | | | | |
| 2. Classification (Group) by Centrifuging | 111 | | | 111 | | 111 | | 111 | | 111 | | 111 | |
| 3. Viscosity (Pa.s) | | 1.86 | | | 2.43 | | 1.8 | | 2.1 | | 2.9 | | 2.2 |
| 4. Yield Points (Dynes/cm$^2$) | | — | | | | | | | | | | | |
| 5. Neutron Diffraction Results | | | | | | | | | | | | | |
| i. Micellar scattering | | | | | | | | | | | | | |
| ii. a No. of other peaks | | | | | | | | | | | | | |
| b Description | | | | | | | | | | | | | |
| c Structural repeat distance (Å) | | | | | | | | | | | | | |
| iii. Suggested Structure | | | | | | | | | | | | | |
| 6. X-ray Diffraction Results | | | | | | | | | | | | | |
| i. Micellar scattering | | | | | | | | | | | | | |
| ii. a No. of other peaks | | | | | | | | | | | | | |
| b Description | | | | | | | | | | | | | |
| c Structural repeat distance (Å) | | | | | | | | | | | | | |
| iii. Suggested Structure | | | | | | | | | | | | | |
| 7. Electron Microscopy Results | | | | | | | | | | | | | |
| i. Corresponding Figure No. | | | | | | | | | | | | | |
| ii. Description | | | | | | | | | | | | | |
| 8. Mobility | Pourable | | | Pourable | | Pourable | | Pourable | | Pourable | | Pourable | |
| 9. Stability | No sedimentation over 3 months at ambient temp. | | | No sedimentation over 1 month at laboratory ambient temperature | | No sedimentation over 1 month at laboratory ambient temperature | | No sedimentation over 1 month at labatory ambient temperature | | No sedimentation over 1 month at laboratory ambient temperature | | No sedimentation over 1 month at laboratory ambient temperature | |

| | Examples | | | | | | | | | | | |
|---|---|---|---|---|---|---|---|---|---|---|---|---|
| | 61 | | | 62 | | 63 | | 64 | | 65 | | |
| 1. Centrifuge Test Results | | | | | | | | | | | | |
| i. No. of Phases Separated | 1 | 2 | 3 | 1 | 2 | 1 | 2 | 1 | 2 | 1 | 2 | 3 |
| ii. Description | Opaque solid/ paste | Clear thin liquid | Opaque solid/ paste | Opaque solid/ paste | Clear viscous liquid | Opaque solid/ paste | Cloudy viscous liquid | Opaque solid/ paste | Cloudy viscous liquid | Opaque solid/ paste | Clear thin liquid | Solid/ paste |
| iii. Proportion (%) | 5(v/v) | 45 | 50 | 95.0 | 5.0 | 42.8 | 57.2 | 51.0 | 49.0 | 10(v/v) | 40 | 50 |
| iv. Surfactant content (%) | | 0.05 | | | 26.2 | | 21.3 | | 22.5 | | 0.01 | |
| v. Loss on drying at 110° C. (%) | | | | | | | | | | | | |
| vi. Viscosity (Pa.s) at 20° C. | | | | | | | | | | | | |
| 2. Classification (Group) by Centrifuging | | 111 | | | 111 | | 111 | | 111 | | 111 | |
| 3. Viscosity (Pa.s) | | 8.1 | | | 6.0 | | 3.26 | | 5.60 | | 0.75 | |
| 4. Yield Points (Dynes/cm$^2$) | | | | | | | | | | | | |
| 5. Neutron Diffraction Results | | | | | | | | | | | | |
| i. Micellar scattering | | | | | | | | | | | | |
| ii. a No. of other peaks | | | | | | | | | | | | |
| b Description | | | | | | | | | | | | |
| c Structural repeat distance (Å) | | | | | | | | | | | | |
| iii. Suggested Structure | | | | | | | | | | | | |

-continued

Figure 10:
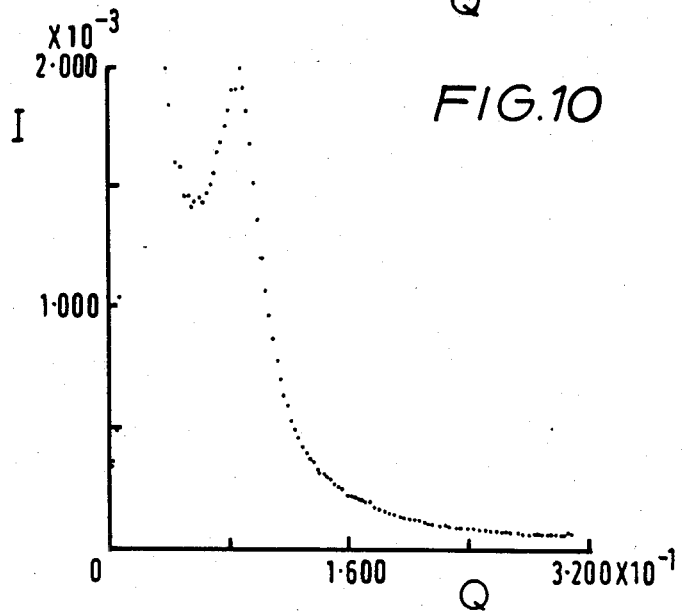
Figure 11:
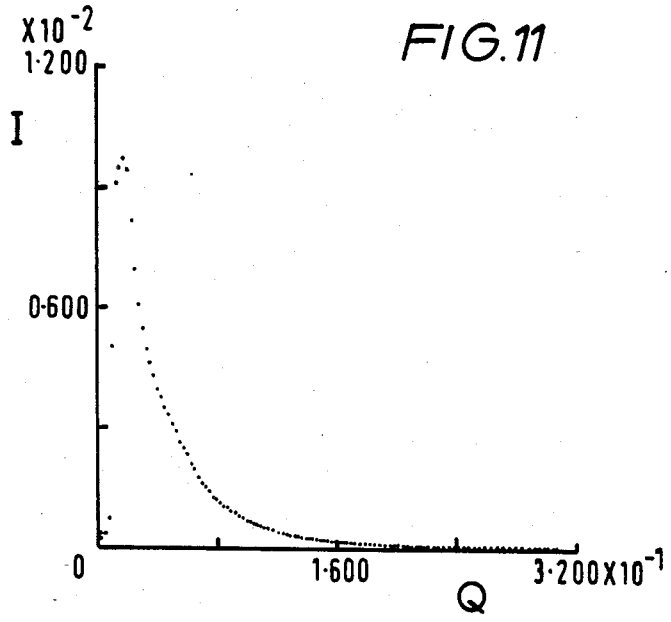

| | | | | | | | |
|---|---|---|---|---|---|---|---|
| 6. X-ray Diffraction Results | | | | | | | |
| i. Micellar scattering | | | | | | | |
| ii. a No. of other peaks | | | | | | | |
| b Description | | | | | | | |
| c Structural repeat distance (Å) | | | | | | | |
| iii. Suggested Structure | | | | | | | |
| 7. Electron Microscopy Results | | | | | | | |
| i. Corresponding Figure No. | | | | | | | |
| ii. Description | | | | | | | |
| 8. Mobility | Viscous but Pourable | Viscous but Pourable | Pourable | Viscous but Pourable | Readily Pourable | | |
| 9. Stability | No sedimentation over 1 month at laboratory ambient temperature | No sedimentation over 1 month at laboratory ambient temperature | No sedimentation over 1 month at laboratory ambient temperature | No sedimentation over 1 month at laboratory ambient temperature | No sedimentation over 1 month at laboratory ambient temperature | | |
| | | | Examples | | | | |
| | | | 66 | A | | B | |
| 1. Centrifuge Test Results | | | | | | | |
| i. No. of Phases Separated | | | 1 | 2 | 1 | 2 | 1 | 2 |
| ii. Description | | | Opaque solid paste | Clear thin liquid | Opaque solid paste | Opaque viscous liquid | Opaque solid paste | Opaque viscous liquid |
| iii. Proportion (%) | | | 64.0 | 36.0 | 24 | 76 | 33(v/v) | 67 |
| iv. Surfactant content (%) | | | | 0.2 | | 17.3 | | 13.5 |
| v. Loss on drying at 110° C. (%) | | | | | | 77.0 | | |
| vi. Viscosity (Pa.s) at 20° C. | | | | | | 0.26 | | 0.17 |
| 2. Classification (Group) by Centrifuging | | | 111 | | I | | I | |
| 3. Viscosity (Pa.s) | | | 0.56 | | 0.3 | | 0.34 | |
| 4. Yield Points (Dynes/cm$^2$) | | | | | 4 | | <0.5 | |
| 5. Neutron Diffraction Results | | | | | | | | |
| i. Micellar scattering | | | | | very broad with Superimposed peaks | | very wide | |
| ii. a No. of other peaks | | | | | None | | None | |
| b Description | | | | | — | | — | |
| c Structural repeat distance (Å) | | | | | — | | — | |
| iii. Suggested Structure | | | | | conc. micellar dispersion See FIG. 10 | | conc. dispersion See FIG. 11 | |
| 6. X-ray Diffraction Results | | | | | | | | |
| i. Micellar scattering | | | | | very wide | | very wide | |
| ii. a No. of other peaks | | | | | one | | none | |
| b Description | | | | | small | | — | |
| c Structural repeat distance (Å) | | | | | 20Å | | — | |
| iii. Suggested Structure | | | | | conc. micellar dispersion | | conc dispersion | |
| 7. Electron Microscopy Results | | | | | | | | |
| i. Corresponding Figure No. | | | | | See FIG. 17 | | See FIG. 18 | |
| ii. Description | | | | | Spheroidal features | | Granular appearance No apparent micro-structure | |
| 8. Mobility | | | Readily Pourable | | Readily Pourable | | Readily Pourable | |
| 9. Stability | | | No sedimentation over 1 month at laboratory ambient temperatures | | No sedimentation over 12 months at ambient temperature | | No sedimentation over 2 months at ambient temperature | |

Certain of the foregoing examples were tested for washing performance as follows:

Series 1

Representative high foaming formulations were each compared with a standard powder formulation in machine washing tests on two different standard soiled fabric samples.

| Example | Cotton | Polyester/ Cotton | Conditions | |
|---|---|---|---|---|
| 31 | 95% | 100% | Temp. | 50° C. |
| 55 | 90% | 70% | Water | 300 ppm calcium carbonate |
| 16 | 100% | 100% | Time | 30 mins. |
| 33 | 95% | 110% | Conc. = | Equivalent effective Wash Solids |
| Powder Standard | 100% | 100% | | |

The term "Effective Wash Solids" refers to the sum of the Active Ingredient and Builder. The powder standard was used at 6 gm/l and the Examples adjusted to give the same % Effective Wash Solids in the wash Liquor.

Series 2

Representative formulations of both high and low foaming types were tested against equal wt. dosage at three temperatures.

| Example | % Effective Wash Solids | Cotton 40° | Cotton 60° | Cotton 85°+ | Polyester/Cotton 40° | Polyester/Cotton 60° | Polyester/Cotton 85°+ |
|---|---|---|---|---|---|---|---|
| 43 (c) | 93 | 75 | 100 | 95 | 75 | 85 | 50 |
| 36 | 66 | 85 | 85 | 100 | 80 | 95 | 75 |
| 50 (c) | 93 | 110 | 110 | 95 | 180 | 200 | 200 |
| Powder Standard | 100 | 100 | 100 | 100 | 100 | 100 | 100 |

| Conditions: | | |
|---|---|---|
| | Temp | 40°, 60° and 85° C.+ |
| | Water | 300 ppm hardness |
| | Time | 30 mins. |
| | Conc. | 6 gm/l (as received) |

Series 3

In this series low foaming non-ionic based examples were tested against the powder standard.

| Example | % Effective Wash Solids | Cotton | Polyester/ Cotton |
|---|---|---|---|
| 52 | 70 | 110% | 100% |
| 53 | 66 | 105% | 90% |
| 54 | 61 | 115% | 120% |
| Standard | | | |

Conditions

| | |
|---|---|
| Temp. | 50° C. |
| Water | 300 ppm hardness |
| Time | 30 mins |
| Conc. | |
| powder | 6 gm/l |
| examples | 11 gm/l |

Series 4

Two low foam non-ionic formulations were tested on naturally soiled fabric (15 successive washes with natural soiling)

| Conditions: | | |
|---|---|---|
| | Temperature | 50° C. |
| | Water | 300 ppm hardness (wash and rinse) |
| | Wash time | 30 mins |
| | Fabric | 65:35 white polyester:cotton |
| | Concentration | EQUAL WEIGHT i.e. 6 gm/l |
| Results: | | |
| Example | | |
| 52 = | 100% Std | Optical whitener efficiency |
| 54 = | 75% Std | |
| 52 = | 95–100% | Soil Removal and Deposition efficiency |
| 54 = | 95–100% | |

The two examples where also compared against the three liquid laundry products which have performed best in our tests out of all those available commercially in Europe at the date of testing.

Both examples gave superior washing performance to all three commercial products.

DRAWINGS

FIGS. 1 to 11 of the drawings are neutron scattering spectra illustrative of the different Groups hereinbefore described. All were prepared, using deuterium oxide based analogs of certain examples of the invention and of the two comparative examples, on the Harwell small angle neutron scattering spectrometer at a wavelength of 6.00 Angstrom.

The Figures correspond to the following examples:

| FIG. | Example |
|---|---|
| 1 | 5(a) |
| 2 | 18 |
| 3 | 21 |
| 4 | 25 |
| 5 | 39 |
| 6 | 36 |
| 7 | 50(b) |
| 8 | 53 |
| 9 | 52 |
| 10 | A (comparative) |
| 11 | B (comparative) |

The FIGS. 12 to 18 are electron micrographs prepared on the Lancaster University low temperature scanning electron microscope using freeze fracture etched samples, as follows:

| FIG. | Example | Magnification |
|---|---|---|
| 12 | 5(b) | ×2,000 |
| 13 | 36 | ×3,000 |
| 14 | 41 | ×2,000 |
| 15 | 41 | ×3,000 |
| 16 | 53 | ×3,000 |
| 17 | Commercial Product corresponding to 'A' | ×2,000 |
| 18 | Commercial Product corresponding to 'B' | ×3,000 |

Figure 17:
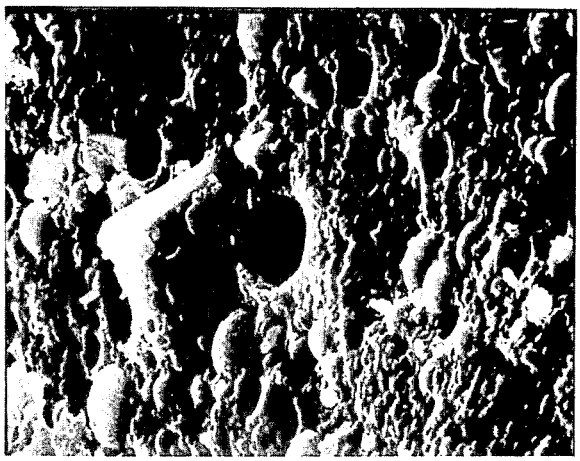
Figure 18:
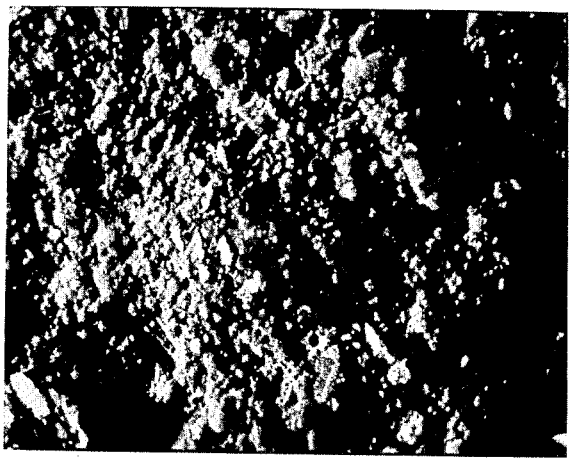

FIGS. 17 and 18 relate to the actual commercial products as purchased.

We claim:

1. A substantially stable, Non-sedimenting, Pourable, fluid, detergent composition having a yield point of at least 10 dynes $cm^{-2}$ and containing Active Ingredients and Builder, said composition having a payload of at least 25% by weight and comprising: at least one, predominantly aqueous, liquid Separable Phase containing sufficient dissolved Electrolyte to provide from 2 to 4.5 gram ions per liter of said phase, of total alkali metal, alkaline earth metal or ammonium; suspended solid particulate Builder; and one or more other Separable Phases Interspersed therewith; the Electrolyte being sufficient to salt out at least a substantial proportion of the surfactant from said predominantly aqueous phase to form a part of said other phase or phases thereby inhibiting sedimentation of said Builder.

2. A non-sedimenting, Pourable, fluid, detergent composition comprising: at least one, predominantly aqueous liquid Separable Phase containing sufficient dissolved Electrolyte to provide from 2 to 4.5 gm moles per liter of said phase of sodium ion; at least one other separable Phase containing Active Ingredients and Builder; the Payload of said composition being above the minimum level at which the Formulation is Non-sedimenting but below the maximum level at which the Formulation is Pourable.

3. A substantially stable, Non-sedimenting, Pourable, fluid detergent composition comprising water, dissolved Electrolyte, suspended solid Builder, from about 5 to about 35% by weight of Active Ingredients and a Payload of greater than about 25% which, on Centrifuging at 800 times normal Earth gravity for 17 hours at 25° C., is separable into a single liquid layer containing sufficient dissolved Electrolyte to provide from 2 to 4.5 gm moles sodium ion per liter of said layer and a solid layer containing surfactant and Builder.

4. A substantially stable, Non-sedimenting, Pourable detergent composition having a payload of at least 35% and consisting essentially of water; from 15 to 60% Dry Weight of surfactant based on the Dry Weight of the composition at least partly present as a Lamellar Separable Phase; and from 20 and 80% Dry Weight of Builder based on the Dry Weight of the composition at least partly present as suspended solid; and wherein said surfactant consists predominantly of anionic sulphated surfactant; 0 to 10% of the Usual Minor Ingredients; 0 to 20% Dry Weight of the composition of nonionic Foaming Agent and/or Foam Stabilizer; and 0 to 6% by Dry Weight of the composition of soap.

5. A substantially stable, Pourable, Non-sedimenting, fluid, liquid detergent composition consisting essentially of water and; (A) From 10 to 20% based on the Dry Weight of the composition of a mixture of $C_{10-18}$ alkyl benzene sulphonate and $C_{10-20}$ alkyl 1–10 mole ether suphate; (B) at least 20% of the composition of total Builder partly present as suspended solid, selected from sodium tripolyphosphate, zeolyte, sodium carbonate, sodium silicate and mixtures thereof; (c) an aqueous Separable Phase containing sufficient dissolved electroltye selected from sodium tripolyphosphate, sodium carbonate sodium silicate and mixtures thereof to provide from 2 to 4.5 gm mole per liter of sodium ion in said phase; and (D) up to 10% of any of the Usual Minor Ingredients; the Payload of said composition being above the minimum at which said composition is Non-sedimenting but below the maximum at which it is Pourable.

6. A substantially stable, Non-sedimenting, Pourable, fluid, detergent composition containing water, about 5 to about 35% by Weight of Active Ingredients, dissolved Electrolyte, suspended solid Builder and a Payload of at least 25% by weight which, on Centrifuging at 800 times Normal Earth Gravity for 17 hours at 25° C., separates a predominantly aqueous Liquid Layer containing sufficient of said dissolved Electrolyte to provide from 2 to 4.5 gm ions per liter of alkali metal in said Layer, said Payload being above the Minimum level at which the Formulation is Non-sedimenting but below the Maximum level at which the Formulation is Pourable.

7. A composition according to claim 6, wherein said Electrolyte consists essentially of at least one compound selected from Functional Ingredients, water-soluble organic salts, chlorides and nitrates.

8. A composition according to claim 7, wherein said Electrolyte is selected from water soluble Builders, compatible bleaches and buffers which tend to salt out said Active Ingredients.

9. A composition according to claim 6, wherein said Electrolyte consists essentially of at least one compound selected from alkali metal chlorides, nitrates, phosphates, phosphonates, citrates, nitrilotricacetates, zeolites, ethylenediamine tetracetates, carbonates and silicates.

10. A composition according to claim 6, wherein said solid Builder selected from condensed phosphates, phosphonates, orthophosphates, carbonates, zeolites and mixtures thereof.

11. A composition according to claim 6, wherein the total Builder comprises a major proportion by weight, of sodium tripolyphosphate.

12. A composition according to claim 6, wherein the Active Ingredients constitute from 10 to 20% of the weight of said composition.

13. A Pourable, Non-sedimenting, fluid detergent composition consisting essentially of water and: (A) from 10 to 20% based on the weight of the composition of Active Ingredients selected from substantially linear sodium alkyl benzene sulphonates having from 10 to 20 aliphatic carbon atoms and mixtures thereof with at least one of an alkyl ethoxy sulphate having an alkyl group with from 10 to 20 carbon atoms, a non-ionic surfactant and a soap; (B) at least 15% of Builder partly present as solid and selected from condensed phosphates, carbonates, zeolites, citrates, nitrilotriacetates, ethylenediamine tetracetates, orthophosphates, silicates and mixtures thereof, wherein at least 50% by weight of said Builder is sodium tripolyphosphate and said Builder further comprises at least 4.2%, based on the total weight of the composition, of sodium carbonate; (C) from 0 to 2.5% by weight of the composition of carboxymethylcellulose; (D) from 0 to 1% by weight of the composition of optical brightening agent; and (E) not more than minor proportions of ingredients selected from enzymes, chemically compatible bleaches, antifoams, cationic fabric softeners, smectite clays, fragrances, dyes and sodium chloride.

14. A Pourable, Non-sedimenting, fluid, liquid detergent composition consisting essentially of water and (A) from 10 to 20% based on the weight of the composition of a mixture of substantially linear $C_{10-18}$ alkyl benzène sulphonate and $C_{10-20}$ alky 1–10 mole ethoxy sulphate; (B) at least 15% by weight of the composition of total Builder partly present as suspended solid, selected from sodium tripolyphosphate, zeolite, sodium carbonate, sodium silicate and mixtures thereof; (C) an aqueous Separable Phase containing sufficient dissolved Electrolyte selected from sodium tripolyphosphate, sodium carbonate, sodium silicate and mixtures thereof to provide from 2 to 4.5 gm mole per liter of sodium ion in said phase; and (D) up to about 10% by weight of any of the Usual Minor Ingredients; and Payload of said composition being above the minimum at which the composition is Non-sedimenting but below the maximum at which it is Pourable.

15. A composition according to claim 6 containing at least 4.7% by weight of the composition of sodium carbonate.

16. A composition according to claim 15, wherein the proportion by weight of sodium carbonate is at least 4.7%.

17. A composition according to claim 13, wherein the proportion by weight of sodium carbonate is at least 4.7%.

18. A composition according to claim 17, wherein the proportion by weight of sodium carbonate is at least 5.0%.

19. A composition according to claim 18, wherein the proportion by weight of sodium carbonate is at least 5.6%.

20. A composition according to claim 6 containing from 2.1 to 18% by weight of substantially linear sodium alkyl benzene sulphonate.

21. A composition according to claim 16 containing at least 9.0% weight of sodium alkyl benzene sulphonate.

22. A composition according to claim 16 containing up to 9.6% by weight of sodium alkyl ether sulphate.

23. A composition according to claim 13, wherein said Electrolyte consists essentially of at least one salt selected from sodium carbonate, sodium silicate and sodium tripolyphosphate.

24. A composition according to claim 13 wherein the Active Ingredients comprise a minor proportion of a non-ionic surfactant.

25. A substantially stable, aqueous, fluid detergent medium, capable of suspending solid particulate Builders to form Pourable, Non-sedimenting suspensions consisting essentially of water, about 5 to 35% Active Ingredients and dissolved Electrolyte sufficient to provide from 2 to 4.5 gm ions of alkali metal per liter in said medium and to form with at least a part of said Active Ingredients, a structure capable of suspending said Builder.

26. A composition according to claim 25, wherein said Electrolyte consists essentially of at least one member selected from the group consisting of sodium carbonate, sodium silicate, sodium citrate, sodium ethylenediamine tetracetate, sodium nitrilotriacetate, sodium orthophosphate, sodium condensed phosphates and sodium phosphonates.

27. A composition according to claim 20, wherein said Active Ingredients consist essentially of sodium linear alkyl benzene sulphonate and at least one member selected from the group consisting of sodium alkyl ether sulphate, sodium alkyl sulphate, sodium paraffin sulfonate, sodium olefin sulphonate, non-ionic surfactants and soap.

* * * * *